US010774518B1

(12) United States Patent
Eller

(10) Patent No.: US 10,774,518 B1
(45) Date of Patent: Sep. 15, 2020

(54) SYSTEMS AND METHODS FOR JOINING SPACE FRAME STRUCTURES

(71) Applicant: Lockheed Martin Corporation, Bethesda, MD (US)

(72) Inventor: Michael R. Eller, New Orleans, CA (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 16/159,419

(22) Filed: Oct. 12, 2018

Related U.S. Application Data

(60) Provisional application No. 62/571,712, filed on Oct. 12, 2017.

(51) Int. Cl.
*E04B 1/24* (2006.01)
*E04B 1/19* (2006.01)
*E01D 101/30* (2006.01)

(52) U.S. Cl.
CPC ..... *E04B 1/2403* (2013.01); *E04B 1/1903* (2013.01); *E04B 1/1906* (2013.01); *E01D 2101/30* (2013.01); *E04B 2001/1927* (2013.01); *E04B 2001/1972* (2013.01); *E04B 2001/1981* (2013.01); *E04B 2001/2406* (2013.01); *E04B 2001/2427* (2013.01)

(58) Field of Classification Search
CPC ..... E04B 1/2403; E04B 1/1906; E04B 2001/2406; E04B 2001/1972; E04B 2001/1981; E04B 2001/1927; E04B 1/19; E04B 1/1903; E04B 1/1909; E04B 1/1912; E04B 1/3205; E04B 1/32; E04B 2001/3241; E04B 2001/3247; E01D 2101/30; B62D 27/023; B62D 27/02
See application file for complete search history.

(56) References Cited

U.S. PATENT DOCUMENTS

| | | | | |
|---|---|---|---|---|
| 3,921,360 | A * | 11/1975 | Baldwin | E04B 1/1906 52/655.2 |
| 4,932,807 | A | 6/1990 | Rhodes | |
| 6,378,265 | B1 * | 4/2002 | Konstandt | E04B 1/1903 403/171 |
| 7,476,824 | B2 | 1/2009 | Ananthanarayanan et al. | |
| D614,481 | S * | 4/2010 | Lewis | D8/382 |
| 2004/0182299 | A1 * | 9/2004 | Kent | B28B 7/0029 114/266 |
| 2006/0053729 | A1 * | 3/2006 | Wallner | E04B 1/585 52/655.1 |
| 2010/0071141 | A1 * | 3/2010 | Reiner | E01D 15/124 14/73 |

(Continued)

*Primary Examiner* — Jessie T Fonseca
(74) *Attorney, Agent, or Firm* — Morgan, Lewis & Bockius LLP

(57) ABSTRACT

A strut-and-node truss design that is applicable to all space frame structure designs can be made with using robotic (semi-autonomous and/or fully autonomous) or telerobotic assembly/joining. Nodes can include a 2-dimensional weld path in an effort to reduce the complexity of having to weld in 3-dimensions. Furthermore, each strut to node connection can be concentrated in a small area where each weld can be performed robotically from a fixed position that only requires the robotic weld head to swivel in a small operating window to reach each joint.

20 Claims, 26 Drawing Sheets

(56) References Cited

U.S. PATENT DOCUMENTS

| | | | | |
|---|---|---|---|---|
| 2010/0083605 | A1* | 4/2010 | Wallner | B23B 5/163 52/655.1 |
| 2015/0064375 | A1* | 3/2015 | Kunstadt | E04B 1/35 428/34.1 |
| 2015/0101645 | A1* | 4/2015 | Neville | E04B 1/3211 135/125 |
| 2015/0167713 | A1* | 6/2015 | Schaerer | F16B 7/185 403/171 |
| 2019/0284792 | A1* | 9/2019 | Lopez Blanco | E04B 1/1903 |

* cited by examiner

10

20

SYSTEMS AND METHODS FOR JOINING SPACE FRAME STRUCTURES

CROSS-REFERENCE TO RELATED APPLICATION

This application claims the benefit of U.S. Provisional Application No. 62/571,712, entitled "SYSTEMS AND METHODS FOR JOINING SPACE FRAME STRUCTURES," filed Oct. 12, 2017, the entirety of each of which is incorporated herein by reference.

STATEMENT REGARDING FEDERALLY SPONSORED RESEARCH OR DEVELOPMENT

Not Applicable.

TECHNICAL FIELD

The present description relates in general to space frame structures, and more particularly to, for example, without limitation, systems and methods for joining space frame structures.

BACKGROUND OF THE DISCLOSURE

Space frame structures are one of the efficient and commonly used structures used on Earth and in space. Space frame structures are typically truss-like and are used for constructing: buildings, bridges, aircraft, automobiles, spacecraft, and tensegrity structures. Design of modern space frame structures has not changed much since the advent of mechanical fasteners and fusion welding processes back in the industrial revolution era. Hence many large space frame structures involve intricate assembly steps that require significant human interaction and skill. The majority of space frame structures require highly skilled fusion welders to make difficult pipe welds that are the most complicated and defect-ridden joints because of the difficult fit up, accessibility, and positioning required to make full circumferential welds. Thus far, space frame designs and methods suitable for robotic (semi-autonomous and/or fully autonomous) or telerobotic assembly/joining has not yet emerged as a viable solution to replace "handmade" truss structures.

The description provided in the background section should not be assumed to be prior art merely because it is mentioned in or associated with the background section. The background section may include information that describes one or more aspects of the subject technology.

Figure 1A:
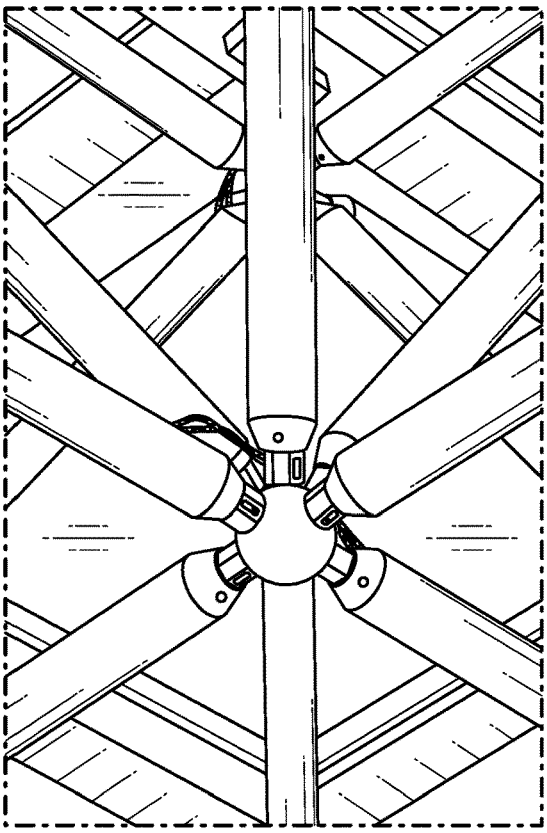
FIG. 1A illustrates a view of an example of a tetrahedral truss structure with tubular strut-and-node joints.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

The present disclosure provides a new design and method for building space frame structures with minimal human interaction. Using robotic assembly and joining methods to build large space frame structures on Earth will have a significant technology roadmap before it is deemed safe for humans to safely work and live on (and under) structures built by robots. Therefore, the most realistic near-term use for robotically manufactured space frame structures is where space frame construction is the most expensive and most difficult for humans to build by hand: outer space.

It can be desirable to build structures in space more efficiently to enable capability growth and capability preservation of various space-based functions such as human exploration, scientific discovery, and satellite operations. A significant limitation to growing and preserving these functions are the high cost and long lead time of transporting payloads into space. The payloads must be designed to withstand up to 10 G launch loads, but will ultimately operate in an environment with 0 G or minimal G-force loads. Therefore, a tremendous amount of design and configuration testing could be eliminated if the payload could be launched into orbit as raw materials and manufactured/assembled in space. Furthermore, the launching of raw materials instead of deployable/unfurlable payloads will create a transformational change in the volumetric packing efficiency within a given launch vehicle's payload fairing. Manufacturing and assembly of raw materials in space is complicated.

Modern space frame structures are expensive to manufacture and are almost always reliant on complex assembly procedures requiring human labor and skills. This is especially true for space transportation solutions because large payloads are required to deploy and unfurl since a suitable design and joining method for robotic assembly has not been developed yet.

One aspect of the present disclosure provides a strut-and-node truss design that is applicable to all space frame structure designs with using innovative robotic (semi-autonomous and/or fully autonomous) or telerobotic assembly/joining. Embodiments of the present disclosure are intended to create transformational change to the space transportation and exploration as well as eventual adoption into terrestrial construction industry.

Figure 1B:
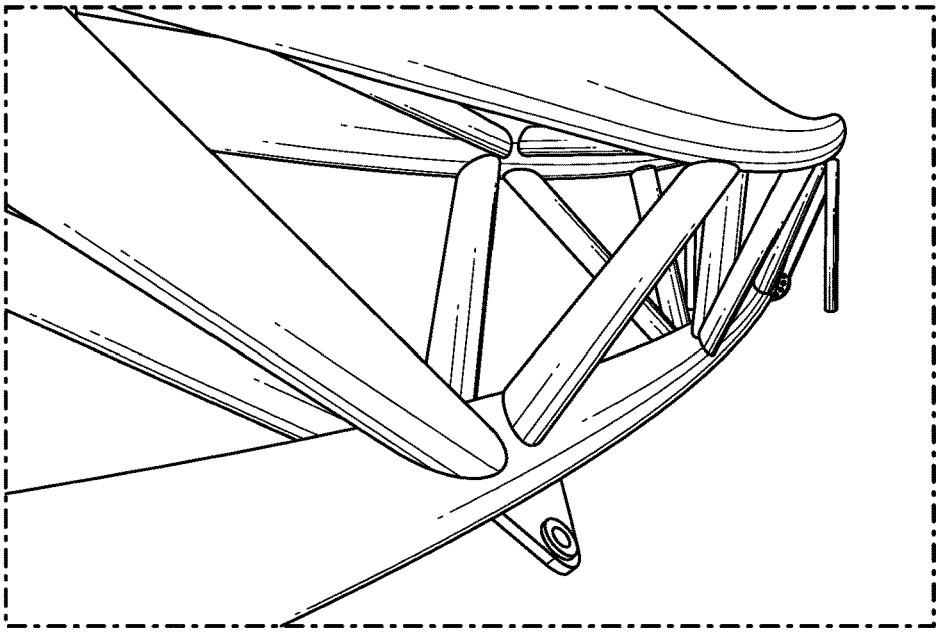
FIG. 1B illustrates a view of an example of a welded truss structure where smaller strut members are precisely fit up and welded to larger strut members.

It can be beneficial to introduce a specific joint that can be joined by robots instead of humans. Common truss structures in use today take advantage of the strut-and-node design to maximize structural stiffness with minimal weight. FIG. 1A illustrates an examples of a tetrahedral truss structure with tubular strut-and-node joints. FIG. 1B illustrates an example of a welded truss structure where smaller strut members are precisely fit up and welded to larger strut members. In these and other examples, the nodes can be brackets with connecting holes, larger strut members, or metallic spheres that are either solid or have threaded inserts. The bracket nodes connect to angular struts with fasteners and the threaded node spheres connect to tubular struts with end fittings that have the matching thread. These struts are screwed into the nodes by hand (and it is worth noting that screw alignment of complex threaded joints is currently not a task done well by robots). The welded truss structures require smaller struts to have precision mitering to ensure proper fit up with the larger strut member (or solid node) and are welded circumferentially in a small volume with limited accessibility, as shown in FIGS. 1A and 1B.

Some embodiments of the present disclosure provide a design that enables a 2-dimensional weld path for the nodes in an effort to reduce the complexity of having to weld in 3-dimensions. Furthermore, each strut to node connection can be concentrated in a small area where each weld can be performed robotically from a fixed position that only requires the robotic weld head to swivel in a small operating window to reach each joint. To access all the strut end joints in this manner, the strut ends can be simply cut at an angle and inserted into an annular slot or groove to position the strut for welding to the node.

Figure 2:
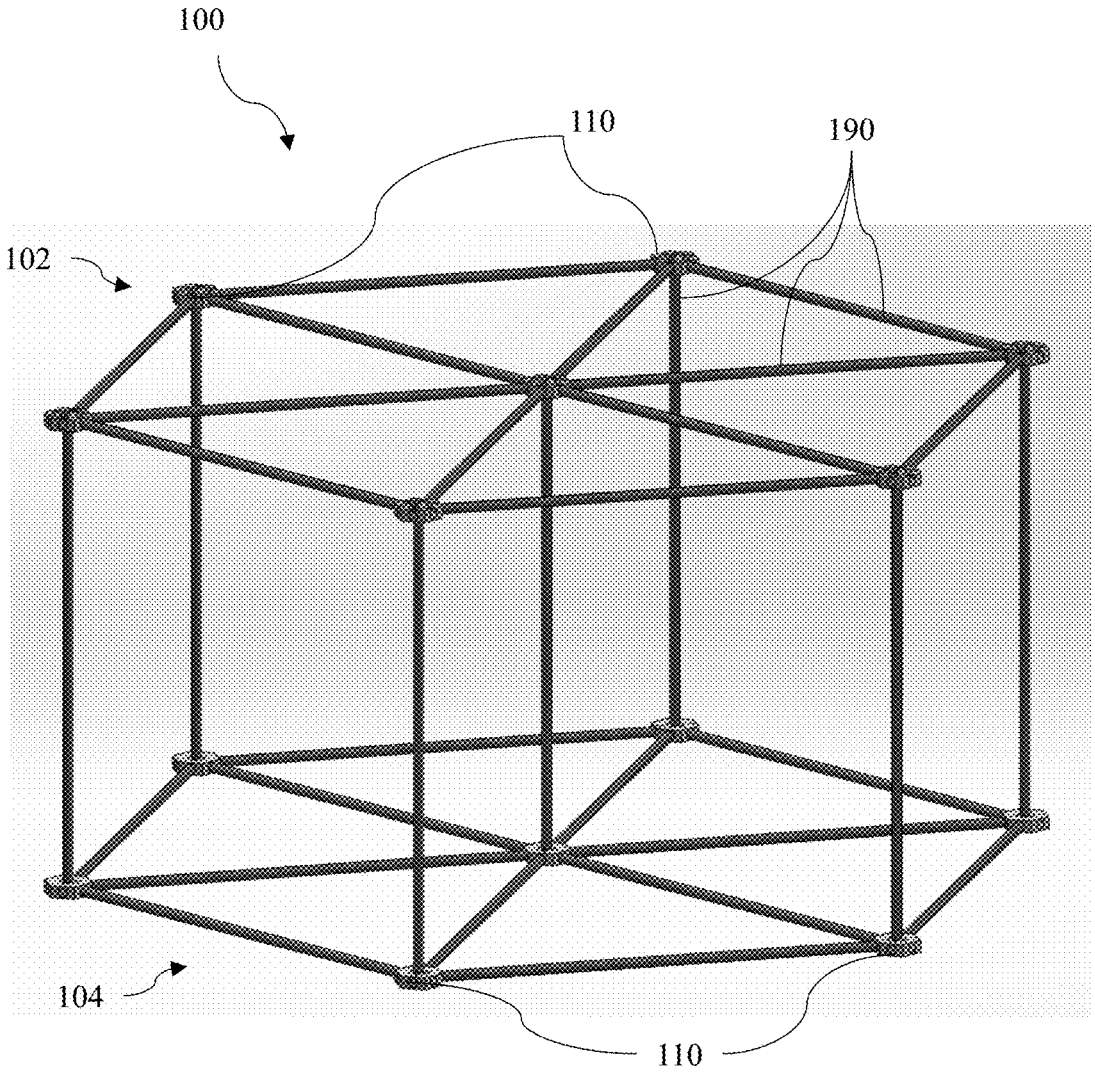
FIG. 2 illustrates a perspective view of an example of a first order (1-ring) truss structure with a hexagonal node design.

FIG. 2 illustrates a perspective view of an example of a first order (1-ring) truss structure with a hexagonal node design. As shown in FIG. 2, when full assembled with node members 110 connecting struts 190 in a hexagonal arrangement, a first order (1-ring) truss 100 can be produced. Robotic assembly and welding is enabled by the joint design in which all the weld joints on a side of the truss structure 100 can be welded on a common side of each corresponding node member 110 (e.g., from just the top or bottom of the truss structure 100). For example, the node members 110 on a first side 102 can provide welding areas all facing in a common first direction, and the node members 110 on a second side 104 can provide welding areas all facing in a common second direction. Hence, the robot(s) do not need to work their way in between the top and bottom plane to access the weld joints. Accessibility between the top and bottom planes can become restrictive as the structure gets larger and more complicated, so the robot can assemble and weld a multitude of these truss structure types without needing to be customized to fit within different size truss members and corresponding clearances.

Figure 3A:
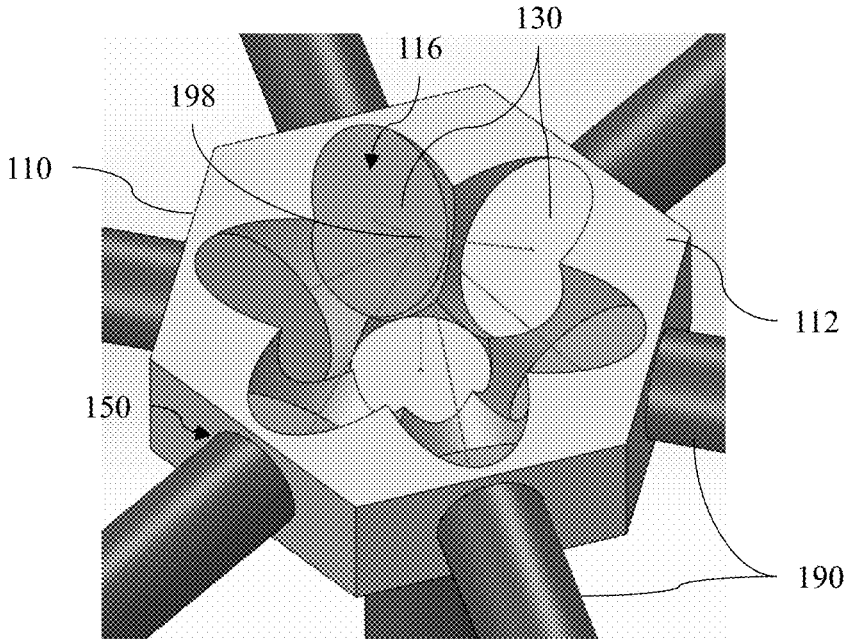
FIG. 3A illustrates a perspective view of an example of a hexagonal node design where the 2-D weld plane is shown as elliptical faces machined out of a solid node member.

FIG. 3A illustrates a perspective view of an example of a hexagonal node design where the 2-D weld plane is shown as elliptical faces machined out of a solid node member. As shown in FIG. 3A, a node member 110 for a truss structure can include a main body 112. The main body 112 can be machined or otherwise formed with features of the node member 110. Additionally or alternatively, features of the node member 110 can be connected to the main body 112. Struts 190 can be inserted into annular grooves 150 of the node member 110. Each annular groove 150 can extend from a periphery of the main body 112 inwardly toward an interior region 116 of the main body 112.

At the interior region 116, weld surfaces 130 are provided facing inwardly. Each weld surface 130 can cover an interior end of a corresponding one of the annular grooves 150. The weld surfaces 130 face in directions that converge at a work point 198. For example, each weld surface 130 can be planar, and a direction orthogonal to the planar weld surface 130 extends toward the work point 198. The directions of each can converge at the single work point 198, so that a weld tool positioned at the work point 198 is aligned with each of the weld surfaces 130. From the work point 198, the weld tool can face one of the weld surfaces 130 in a direction that is orthogonal to the weld surface. As such, the entirety of the weld surface 130 is exposed to the weld tool and arranged in a known position and orientation relative to the weld tool.

Figure 3B:
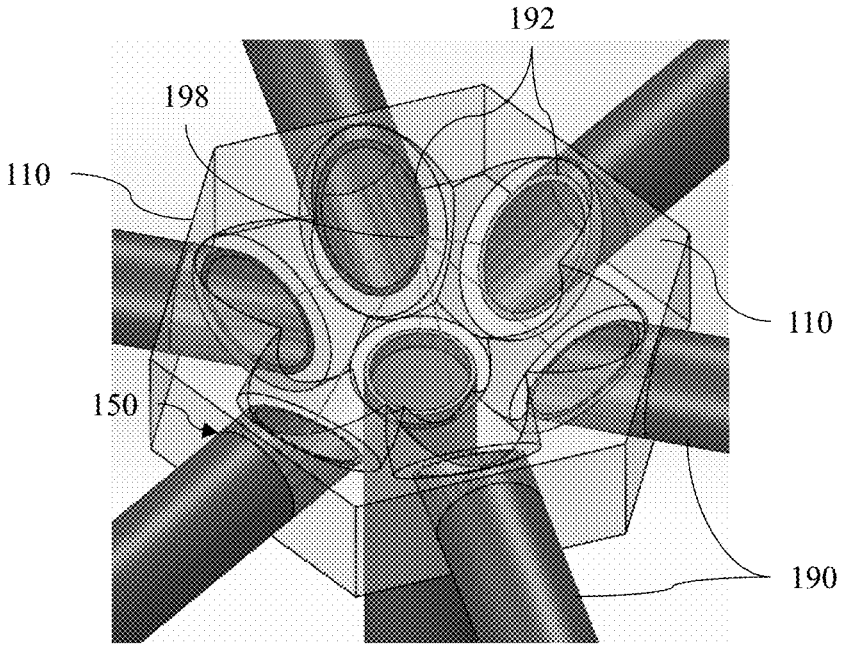
FIG. 3B illustrates a perspective view of the node design of FIG. 3A shown with transparencies showing the angled-cut strut ends fitting into annular slots/grooves to a position that is ideal for welding from a fixed swiveling position.

FIG. 3B illustrates a perspective view of the node design of FIG. 3A shown with transparencies showing the angled-cut strut ends fitting into annular slots/grooves to a position that is ideal for welding from a fixed swiveling position. As shown, terminal ends 192 of each of the struts 190 are positioned within the annular grooves 150 and against the main body 112 of the node member 110.

The struts 190 are illustrated as tubular members, but could also be solid (e.g., filled) members. Since tubular members are more common from a specific stiffness and specific strength point of view, the remaining configurations and design features are optimized for strut ends instead of solid ends; however, all embodiments disclosed herein can incorporate tubular and/or solid members.

Figure 3C:
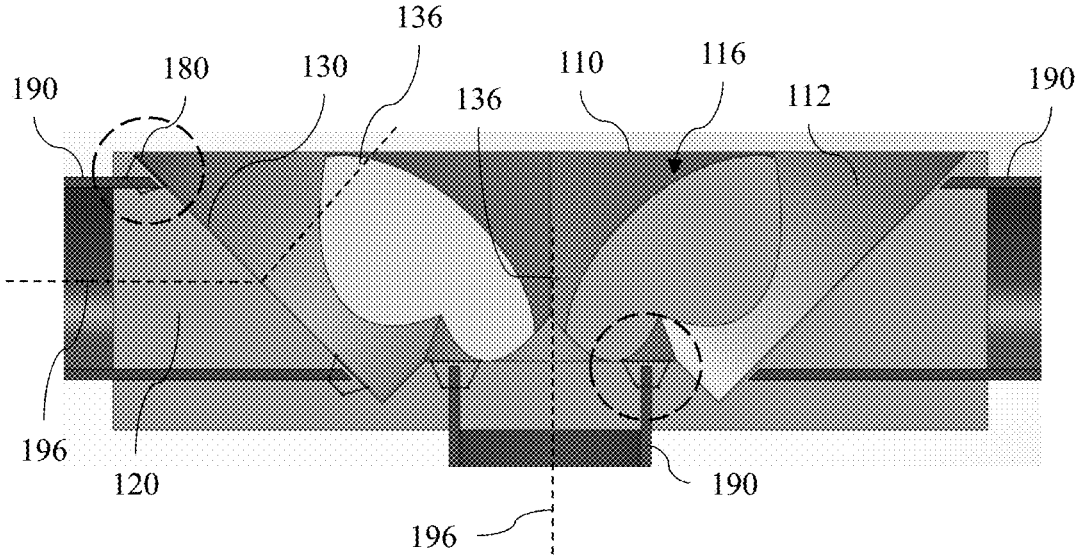
FIG. 3C illustrates a sectional view of the hexagonal node shown in FIGS. 3A and 3B where the strut ends are fit into annular grooves on the sides.

FIG. 3C illustrates a sectional view of the hexagonal node shown in FIGS. 3A and 3B where the strut ends are fit into annular grooves on the sides. The annular grooves 150 can be formed at least in part by anvils 120 that define inner diameters of the annular grooves 150. The struts 190 can receive the anvils 120 as the struts 190 are received into the annular grooves 150. The anvils 120 can be attached to or integrally or monolithically formed with the remainder of the main body 112 of the node member 110.

With the node members 110 and struts 190 described herein, the anvils 120 precisely align the terminal ends 192 with the node member 110 to maintain ideal fit-up tolerances. The anvils 120 also stiffen the strut end by increasing its bending resistance. The anvils 120 also serve as a heat sink for the welding process and prevents blowing through with fusion welds. It should be noted that the hexagonal node shown can be sculpted/machined further to achieve higher stiffness around each joint. The anvils 120 can be cylindrical or another shape. In some embodiments, the anvil 120 can be provided with a tapered end to enable easier insertion while helping with precision alignment.

As shown in FIG. 3C, each of the struts extends along a longitudinal axis 196. The weld surface 130 faces in a direction along a weld axis 136. As discussed previously, the weld axes 136 can converge at the work point. The longitudinal axes 196 need not converge at a single point. As shown in FIG. 3C, the weld surface can face in a direction that is not parallel to the longitudinal axis 196 of the corresponding strut 190, as discussed below with respect to FIG. 3D. Nonetheless, one or more of the struts 190 can be aligned with the weld surface 130 so that the longitudinal axis 196 is coextensive with and/or parallel to the weld axis 136, as discussed below with respect to FIG. 3E.

Figure 3D:
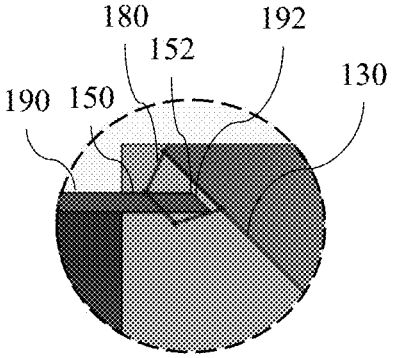
FIG. 3D illustrates an enlarged sectional view of a portion of FIG. 3C.

FIG. 3D illustrates an enlarged sectional view of a portion of FIG. 3C. As shown in FIG. 3D, the terminal ends 192 each fit into a matching annular groove 150 on the perimeter of the node member 110. Each terminal end 192 fits up against a small ligament of the main body 112, separating the interior end 152 of the annular groove 150 and the terminal end 192 of the strut 190 from the weld surface on the opposite side. Welding can be performed along the weld surface 130 to form a weld nugget 180 that extends from the weld surface 130 at least to the interior end 152 of the annular groove 150 and the terminal end 192 of the strut 190. Accordingly, the strut 190 can be welded to the main body 112 of the node member 110. The weld nugget 180 can include added materials or a welding of existing materials without any added materials.

As shown in FIG. 3D, the interior end 152 of the annular groove 150 and the terminal end 192 of the strut 190 can form an angle that provides surfaces parallel to the weld surface 130. Such an angle may formed by cutting or otherwise forming the struts 190 with ends that form surfaces that are not orthogonal to the longitudinal axis of the strut 190.

Figure 3E:
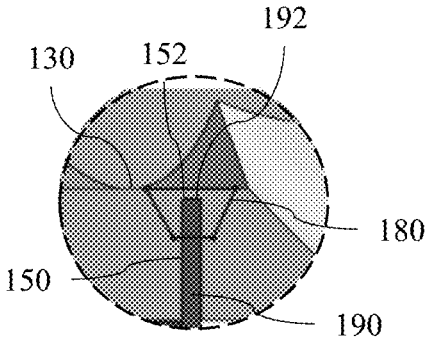
FIG. 3E illustrates an enlarged sectional view of a portion of FIG. 3C.

FIG. 3E illustrates an enlarged sectional view of a portion of FIG. 3C. As shown in FIG. 3E, and similar to the configuration illustrated in FIG. 3D, the terminal ends 192 each fit into a matching annular groove 150 on the perimeter of the node member 110. Welding can be performed along the weld surface 130 to form a weld nugget 180 that extends from the weld surface 130 at least to the interior end 152 of the annular groove 150 and the terminal end 192 of the strut 190. The interior end 152 of the annular groove 150 and the terminal end 192 of the strut 190 can form an angle that provides surfaces parallel to the weld surface 130. In contrast to the configuration illustrated in FIG. 3D, such an angle may formed by cutting or otherwise forming the struts 190 with ends that form surfaces that are orthogonal to the longitudinal axis of the strut 190.

It will be understood that a variety of truss structures can be assembled using the nodes 110 and struts 190 described herein. The illustrated embodiments provide non-limiting examples. It will be understood that arrangements other than those illustrated can be provided.

Figure 4:
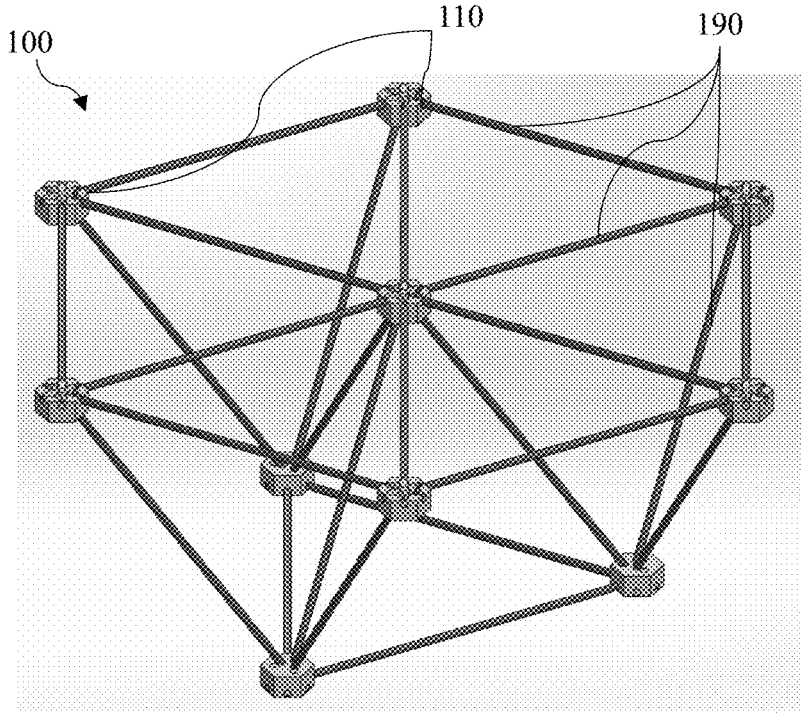
FIG. 4 illustrates a perspective view of an example of a first order (1-ring) truss structure with hexagonal node design.
Figure 5:
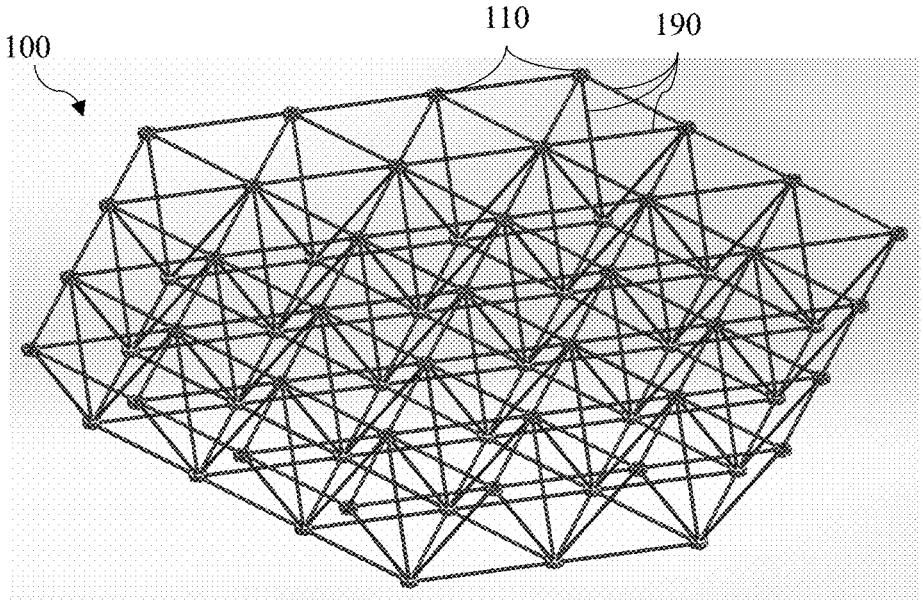
FIG. 5 illustrates a perspective view of an example of a first order (3-ring) truss structure with hexagonal node design.

Referring now to FIGS. 4 and 5, a more complex version of the node member described herein is a tetrahedral node member that enables some of the most efficient space frame structures. Such a truss structure 100 uses similar hexagonal strut-to-node connections, but has three struts 190 coming off the bottom instead of just one. A 1-ring tetrahedral and 3-ring tetrahedral truss structure are shown in FIGS. 4 and 5. The additional strut connections requires a thicker node member 110, but all the strut ends of the struts 190 can still be welded from a fixed, swiveling position on the top plane.

While the tetrahedral structure shown in FIGS. 4 and 5 are illustrated with substantially flat top and bottom faces, it will be understood that these structures can have a parabolic curvature to one or both of the top and bottom faces. A substantially parabolic curvature enables placement of mirrors at the nodes for telescope applications. Such structures can also be used for aerobrake applications.

Figure 6A:
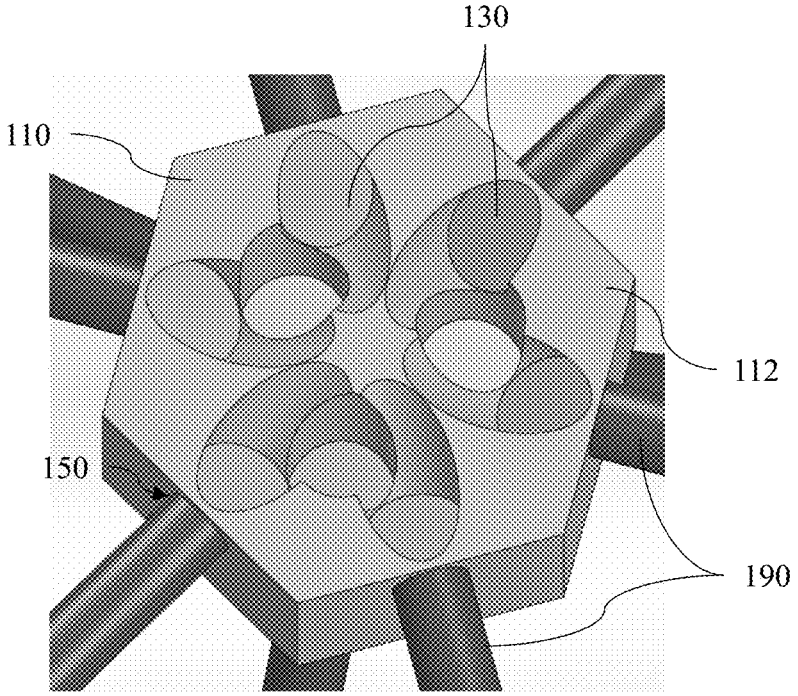
FIG. 6A illustrates a perspective view of an example of a tetrahedral node design where the 2-D weld plane is shown as elliptical faces machined out of a solid node member.
Figure 6B:
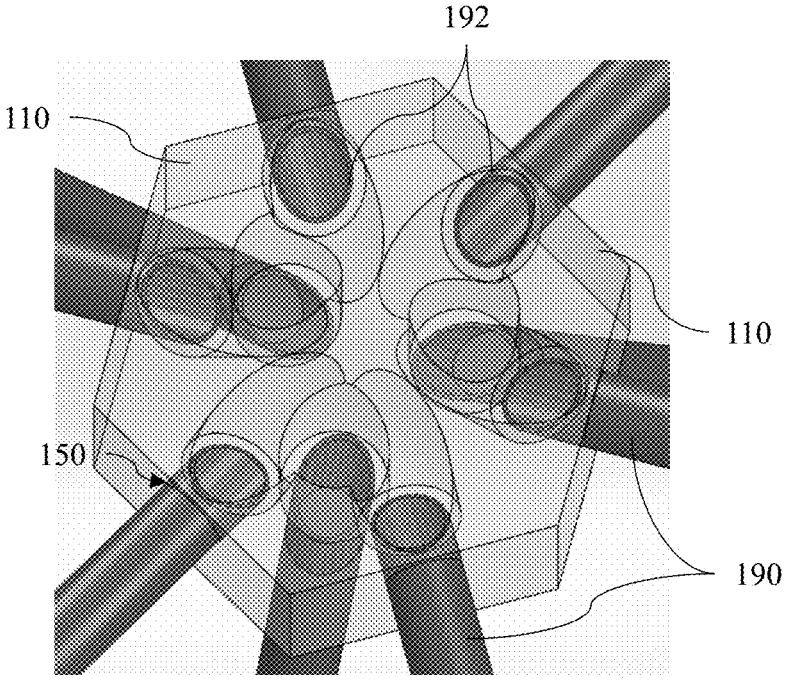
FIG. 6B illustrates a perspective view of the node design of FIG. 6A shown with transparencies showing the angled-cut strut ends fitting into annular slots/grooves to a position that is ideal for welding from a fixed swiveling position.

The truss structures of FIGS. 4 and 5 can be assembled with node and strut configurations illustrated in FIGS. 6A and 6B. FIG. 6A illustrates a perspective view of an example of a tetrahedral node design where the 2-D weld plane is shown as elliptical faces machined out of a solid node member.

As shown in FIG. 6A, a node member 110 for a truss structure can include a main body 112. Struts 190 can be inserted into annular grooves 150 of the node member 110. Each annular groove 150 can extend from a periphery of the main body 112 inwardly toward an interior region of the main body 112. While a greater number of struts 190 and weld surfaces are provided than in the configuration of FIGS. 3A and 3B, the provided weld surfaces 130 can still be provided facing inwardly and in directions that converge at a work point. FIG. 6B illustrates a perspective view of the node design of FIG. 6A shown with transparencies showing the angled-cut strut ends fitting into annular slots/grooves to a position that is ideal for welding from a fixed swiveling position. As shown, terminal ends 192 of each of the struts 190 are positioned within the annular grooves 150 and against the main body 112 of the node member 110.

The hexagonal and tetrahedral truss configuration shown in FIGS. 4-6B have significant applicability to roof structures, flooring structures, structural building supports, bridge structures, and telescopes (both Earth-based and space-based). Another application includes using the tetrahedral truss structure as an effective aerobrake for slowing the entry of spacecraft (either human-rated or non-human-rated) as it enters a celestial body with a thin atmosphere. For all of these scenarios, the nodes shown above can easily be adapted with fastener holes with precision adjustment capability to attach mirrors (in the case of telescopes), heat shield panels (in the case of aerobrakes), and other structural panels for construction or debris shielding/collection.

Figure 7:
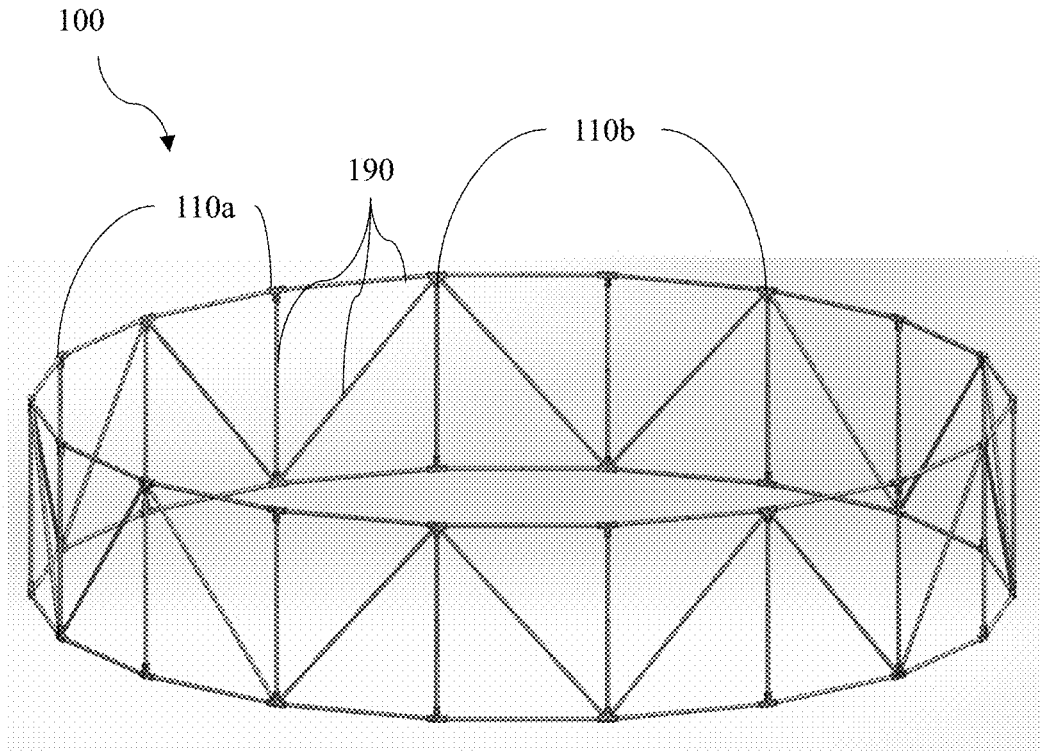
FIG. 7 illustrates a perspective view of an example of a rim truss structure that can be robotically assembled and welded in space.

Referring now to FIG. 7, another application of a node-and-strut design includes assembly of truss structures 100 that serve as structural support for antennas. As shown in FIG. 7, one example of an antenna configuration is a cylindrical truss rim that is the structural stiffening element for a mesh reflector element that is tensioned to the truss rim. The cylindrical rim can be assembled in space from raw materials: struts 190 and node members 110*a* and 110*b*. The struts 190 can be graphite epoxy and bonded aluminum ends and the nodes can be aluminum (titanium is also an acceptable substitute). The robotic assembly would require the struts to be fit up with the nodes with a mechanical connection such as a spring-loaded taper pin or an electrically actuated taper pin. This will position the strut in place while other struts 190 are attached to the node. The concept of operations is that the robot would assemble the entire structure with mechanical connections first to ensure that everything can fit into the proper locations first. This leverages the phenomenon of freeplay in mechanical joints that provides the ability to bend struts slightly to make them fit because the mechanical joints do not completely immobilize the strut 190. Once the structure has been fully assembled with mechanical joints, the robotic welding head can weld each joint using robotic arms to move each section into position under the weld head until all the joints are welded. This allows the rim structure to retain fine assembly tolerances with minimal distortion.

Figure 8:
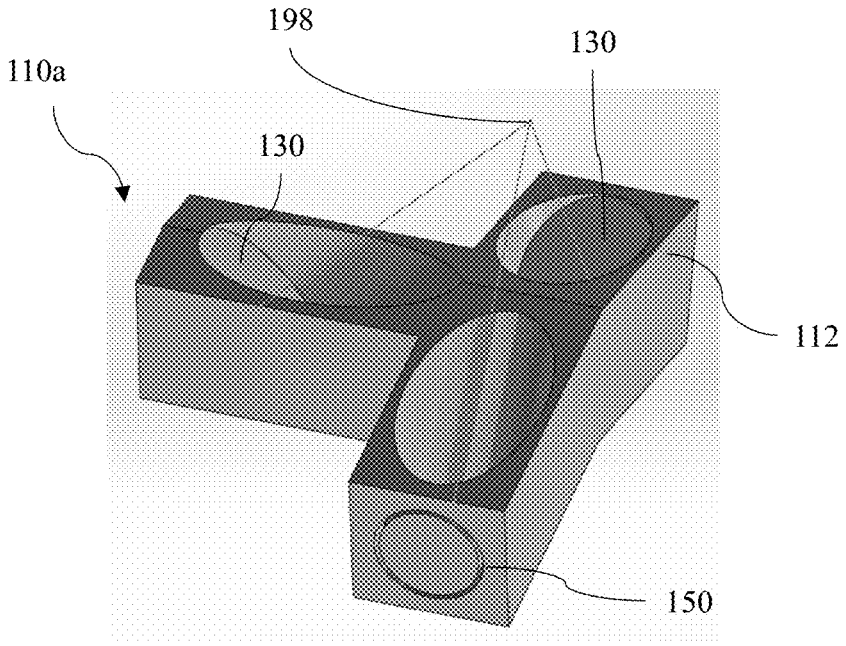
FIG. 8 illustrates a perspective view of an example of cylindrical truss nodes for vertical and horizontal strut struts.
Figure 9:
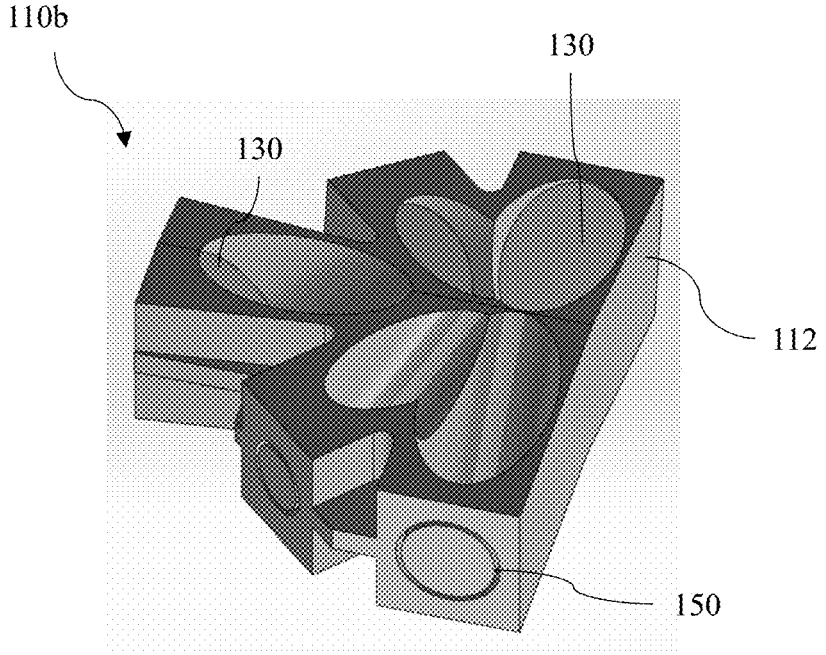
FIG. 9 illustrates a perspective view of another example of cylindrical truss nodes for vertical and horizontal strut struts as well as diagonals.

The truss structure of FIG. 7 can be assembled with node members illustrated in FIGS. 8 and 9.

FIG. 8 illustrates a perspective view of an example of cylindrical truss nodes for vertical and horizontal struts. As shown in FIG. 8, a node member 110*a* for a truss structure can include a main body 112. Struts can be inserted into annular grooves 150 of the node member 110*a*. Each annular groove 150 can extend from a periphery of the main body 112 inwardly toward an interior region of the main body 112. The weld surfaces 130 are provided facing inwardly and in directions that converge at a work point 198. The struts can be arranged to form the vertical and horizontal supports of the truss structure.

FIG. 9 illustrates a perspective view of another example of cylindrical truss nodes for vertical and horizontal strut struts as well as diagonals. As shown in FIG. 9, a node member 110*b* for a truss structure can include a main body 112. Struts can be inserted into annular grooves 150 of the node member 110*b*. Each annular groove 150 can extend from a periphery of the main body 112 inwardly toward an interior region of the main body 112. While a greater number of annular grooves 150 are provided than in the node member 110*a*, the weld surfaces 130 are still provided facing inwardly and in directions that converge at a work point. The struts can be arranged to form the vertical, horizontal, and diagonal supports of the truss structure.

Figure 10A:
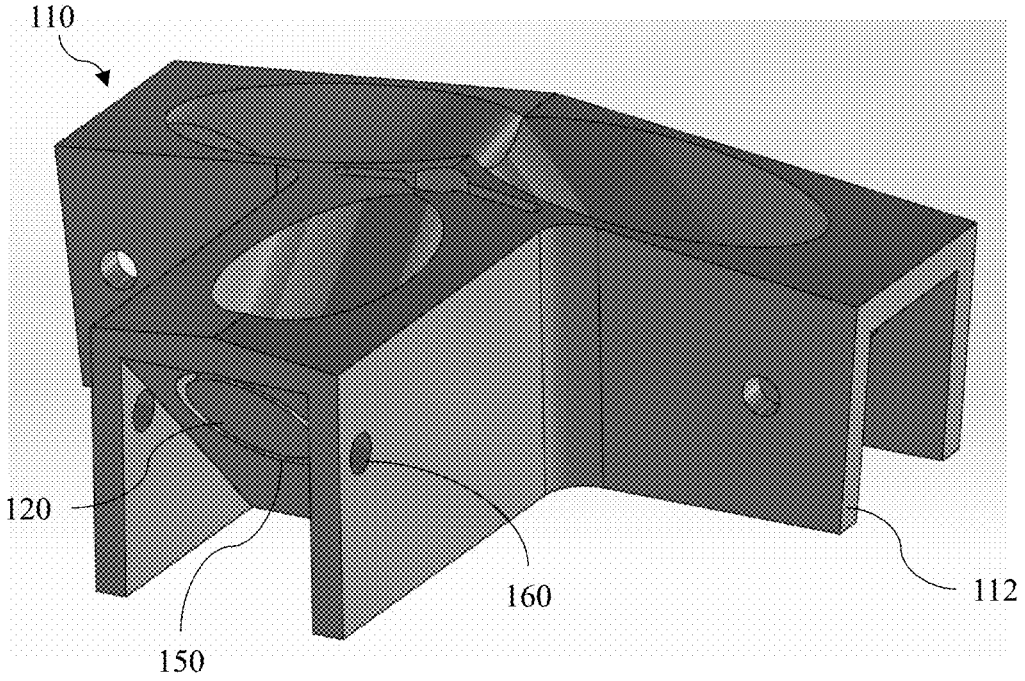
FIG. 10A illustrates a perspective view of an example of a node member with a parallel machined channel.

Referring now to FIGS. 10A-10D, a node member can include various features that facilitate a more cost effective machining approach as well as a more efficient assembly approach. FIG. 10A illustrates a perspective view of an example of a node member with a parallel machined channel. As shown in FIG. 10A, the node member 110 can have a channel 160 that is cut and/or machined to be parallel or nearly parallel to the elliptical welding face 130. The channel 160 can simplify machining of the small annular groove 150 where the strut is inserted. Because the struts may be thin-walled, the precision of the groove 150 is difficult to machine with standard mill bits. Hence, a mill bit with a diameter of 0.050" might only be available in a length of 1" because the depth-to-diameter ratio is not ideal for making precise features with good tolerances. Therefore, the parallel machined channel 160 makes it easier for the small diameter mill bits to machine the annular groove 150 with good tolerances and reasonable feed rate.

Figure 10B:
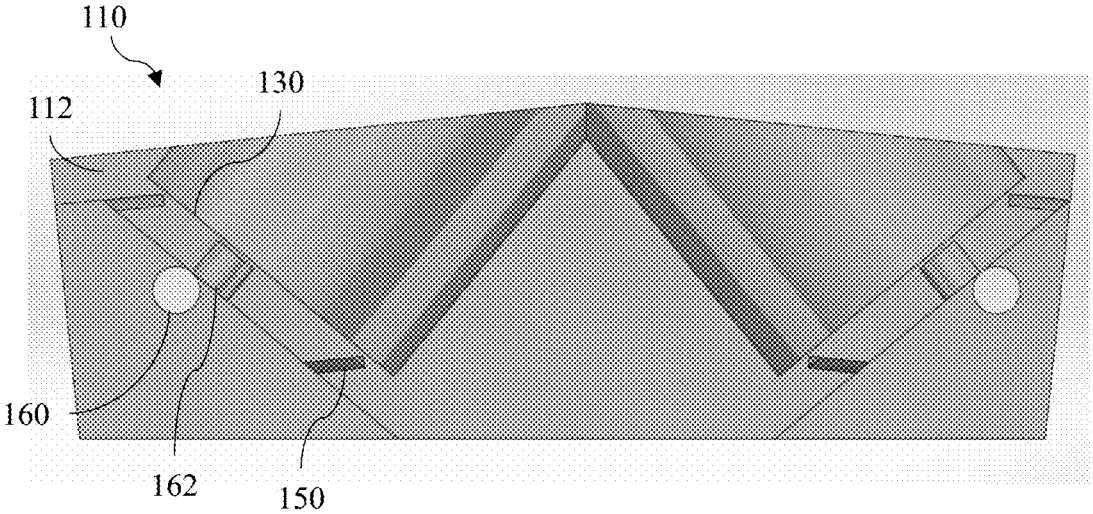
FIG. 10B illustrates a sectional view of the node member of FIG. 10A.

FIG. 10B illustrates a sectional view of the node member of FIG. 10A. As shown in FIG. 10B, the node member 110 can provide a hole 162 for fastening an anvil 120 onto the main body 112 of the node member. The hole 162 can be opposite the weld surface 130. The hole 162 can be threaded or otherwise facilitate coupling.

Figure 10C:
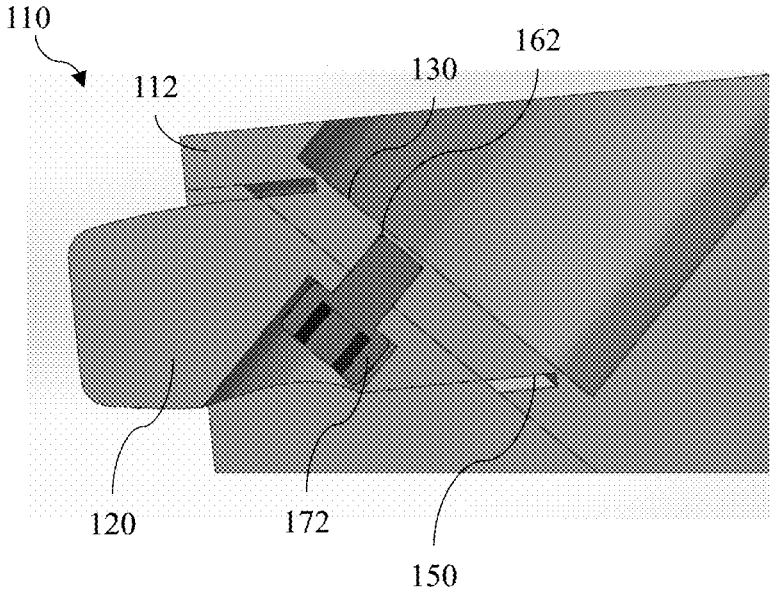
FIG. 10C illustrates a sectional view of an example of an extended tapered anvil attached with a fastener to the node at the backside of the elliptical welding face.

FIG. 10C illustrates another sectional view of the node member of FIG. 10A, with an extended tapered anvil attached with a fastener at the backside of the elliptical welding face. The hole 162 can receive the fastener 172 that couples the anvil 120 to the main body 112. The fastener can be a threaded bolt, a PEM insert, a rivet, or another structure that couples the anvil 120 to the main body 112.

Figure 10D:
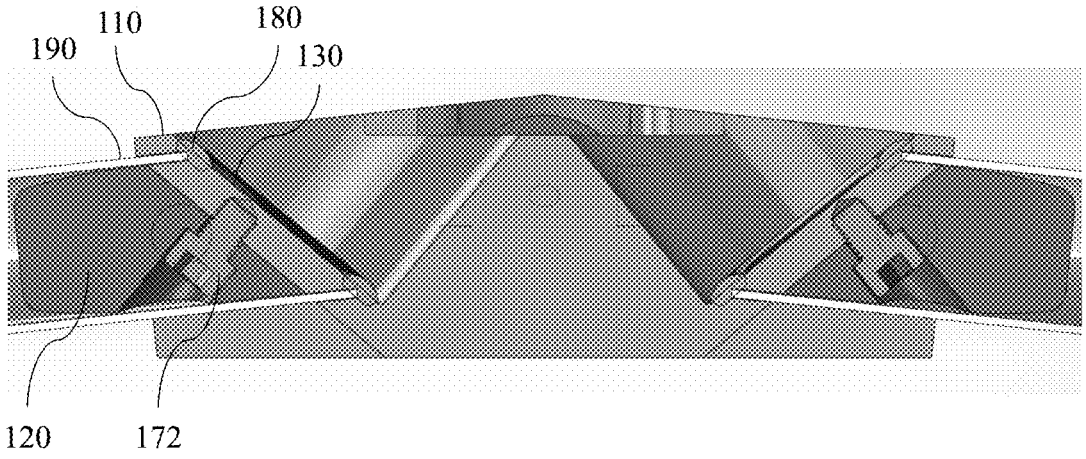
FIG. 10D illustrates another sectional view of an example of an extended tapered anvil attached with a fastener to the node at the backside of the elliptical welding face.

FIG. 10D illustrates another sectional view of an example of an extended tapered anvil attached with a fastener to the node at the backside of the elliptical welding face. As shown in FIG. 10D, the strut 190 can be inserted about the anvil 120 and into the groove 150. Welding can be performed along the weld surface 130 to form a weld nugget 180 that extends from the weld surface 130 at least to the annular groove 150 and the strut 190. The anvil 120 can improve bending stiffness for the strut 190, promote precision alignment, and enable an effective heat sink for welding.

Figure 11A:
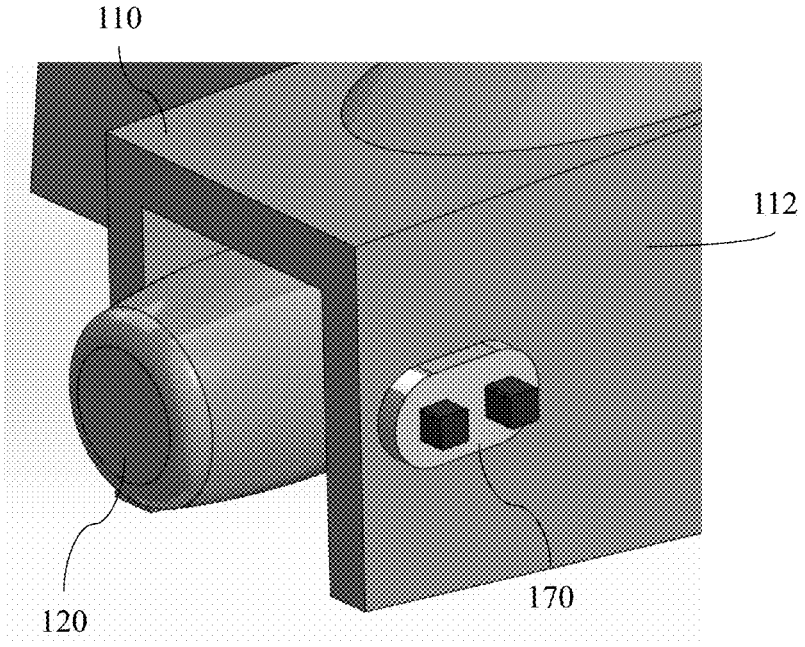
FIG. 11A illustrates a perspective view of an example of a double spring-loaded tapered pin that engages through a strut hole.
Figure 11B:
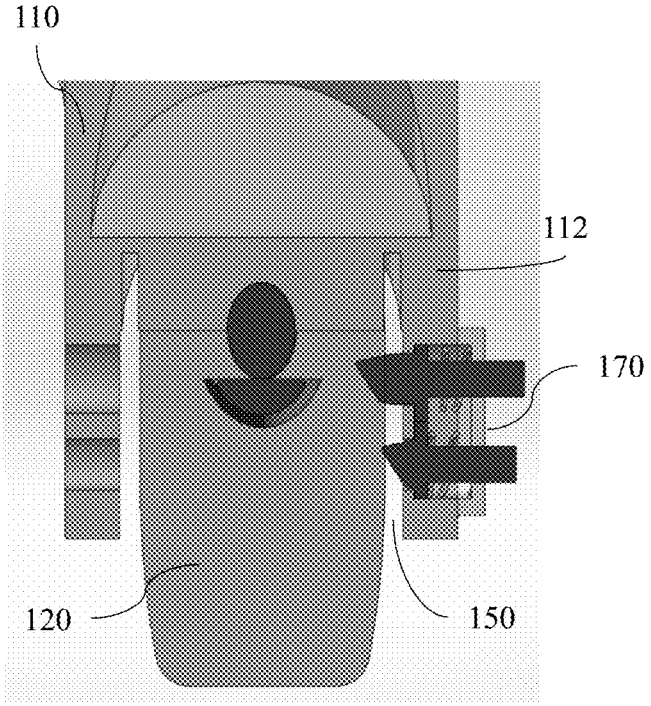
FIG. 11B illustrates a sectional view of the double spring-loaded tapered pin of FIG. 11A.

To assist with the positioning of the strut in the annular groove, a positioning mechanism can be provided. FIG. 11A illustrates a perspective view of an example of a double spring-loaded tapered pin that engages a strut. FIG. 11B illustrates a sectional view of the double spring-loaded tapered pin of FIG. 11A. As shown in FIGS. 11A and 11B, a spring-loaded tapered pin 170 can extend at least partially into the groove 150. The pin is biased to extend inwardly. When a strut is inserted into the groove 150, the pin is allowed to retract until it engages the strut (e.g., by being inserted into a hole in the strut). The bias of the spring allows the pin to remain engaged with the strut to retain the strut within the groove 150 until the pin is otherwise disengaged. Other mechanisms are contemplated. For example, the pin can be electrically, magnetically, chemically, or otherwise actuated and unactuated. The spring-loaded tapered pin 170 can be singular or double and positioned on one or both sides of the strut to promote redundancy. The pin 170 can extend into a tapered hole on the extended tapered anvil 120. The pin 170 can also be engaged using a light sensor and an electrically-actuated pin pusher/puller.

Figure 12:
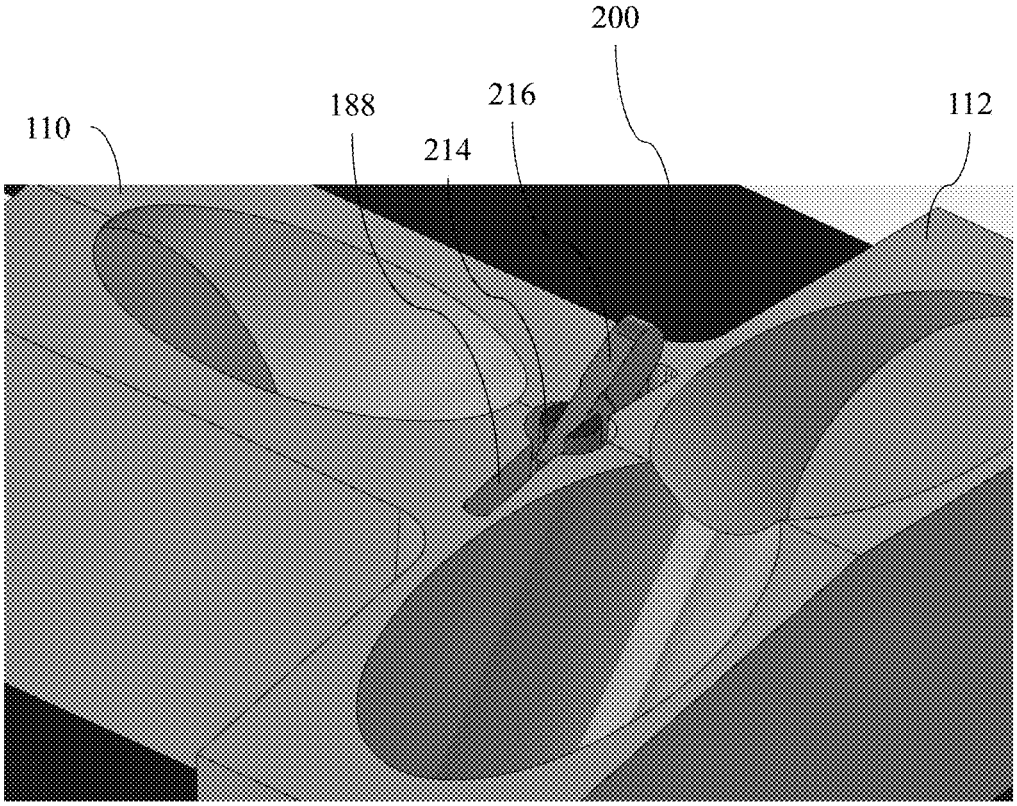
FIG. 12 illustrates a perspective view of an example of a node alignment mechanism (e.g., tapered toggle pin) that holds the node in position against an assembly platform and prevents it from rotating out of position during fit up and welding.

Node members can be positioned before the struts are connected. FIG. 12 illustrates a perspective view of an example of a node alignment mechanism (e.g., tapered toggle pin) that holds the node in position against an assembly platform and prevents it from rotating out of position during fit up and welding. As shown in FIG. 12, the node members 110 can have a hole 188 (e.g., blind hole or through hole) for positioning onto a tapered guide on a fixed assembly platform 200. The node member 110 can have more than one of the holes 188 for redundancy. In one embodiment, the node has a through hole and a square channel to accept a tapered toggle pin 214 with a swiveling latch 216. The latch 216 can be tensioned or electrically-drive to remain in an upright position until the node member 110 has been slid over the pin 214 and comes into contact with the assembly platform 200. The swivel latch 216 can then be pushed or actuated to a 90 degree position to hold node down and prevent it from swiveling.

Figure 13A:
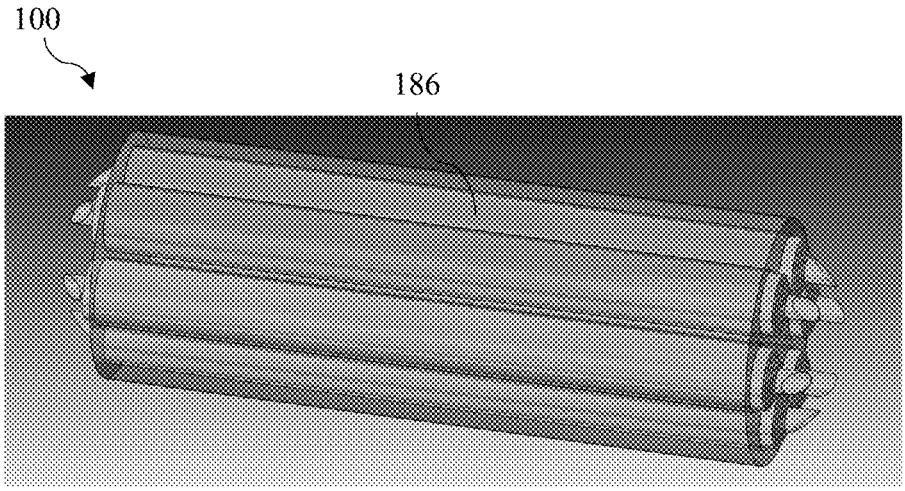
FIGS. 13A and 13B illustrate perspective views of an example of rim truss structure integrated with tensegrity reflector assembly to enable large aperture RF antenna in a collapsed configuration (FIG. 13A) and an expanded configuration (FIG. 13B).
Figure 13B:
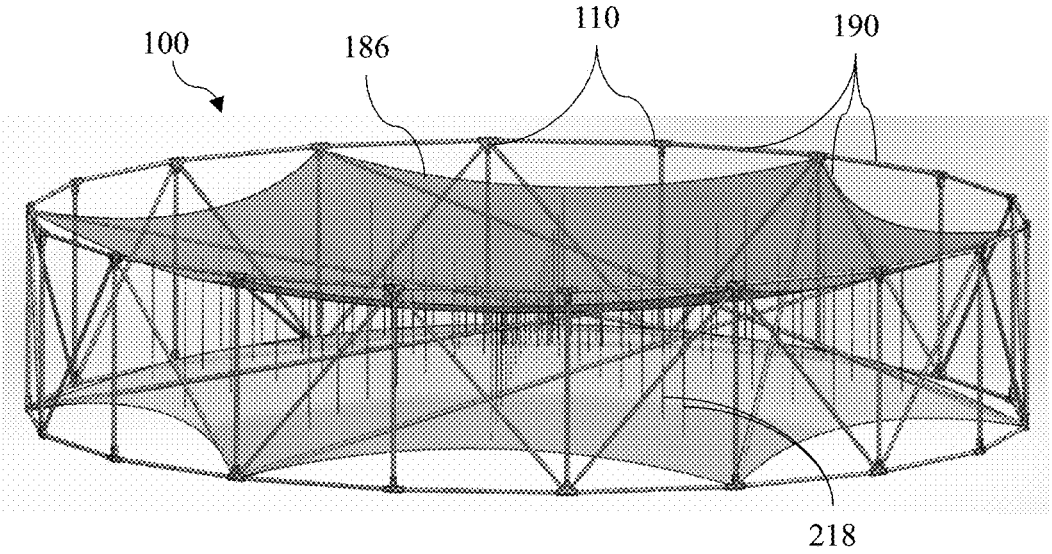

In completion of a cylindrical antenna, the rim truss structure can be integrated with a mesh or mirrored reflecting element to communicate (e.g., with RF signals from Earth). FIGS. 13A and 13B illustrate perspective views of an example of rim truss structure integrated with tensegrity reflector assembly to enable large aperture RF antenna in a collapsed configuration (FIG. 13A) and an expanded configuration (FIG. 13B). As shown in FIGS. 13A and 13B, a reflector element 186 (e.g., mesh) can utilize a tensegrity design that uses struts 190 (e.g., telescoping struts) and tension wires 218 to maintain a large aperture shape with moderate precision. At large diameters, the tensegrity elements interface with the cylindrical rim truss structure via mechanical and/or welded joints at the same nodes 110 used for making the rim truss structure 100. The tension wires 218 can be adjusted using robotic arms and mechanisms after it has been joined to the rim truss structure 100.

Figure 14:
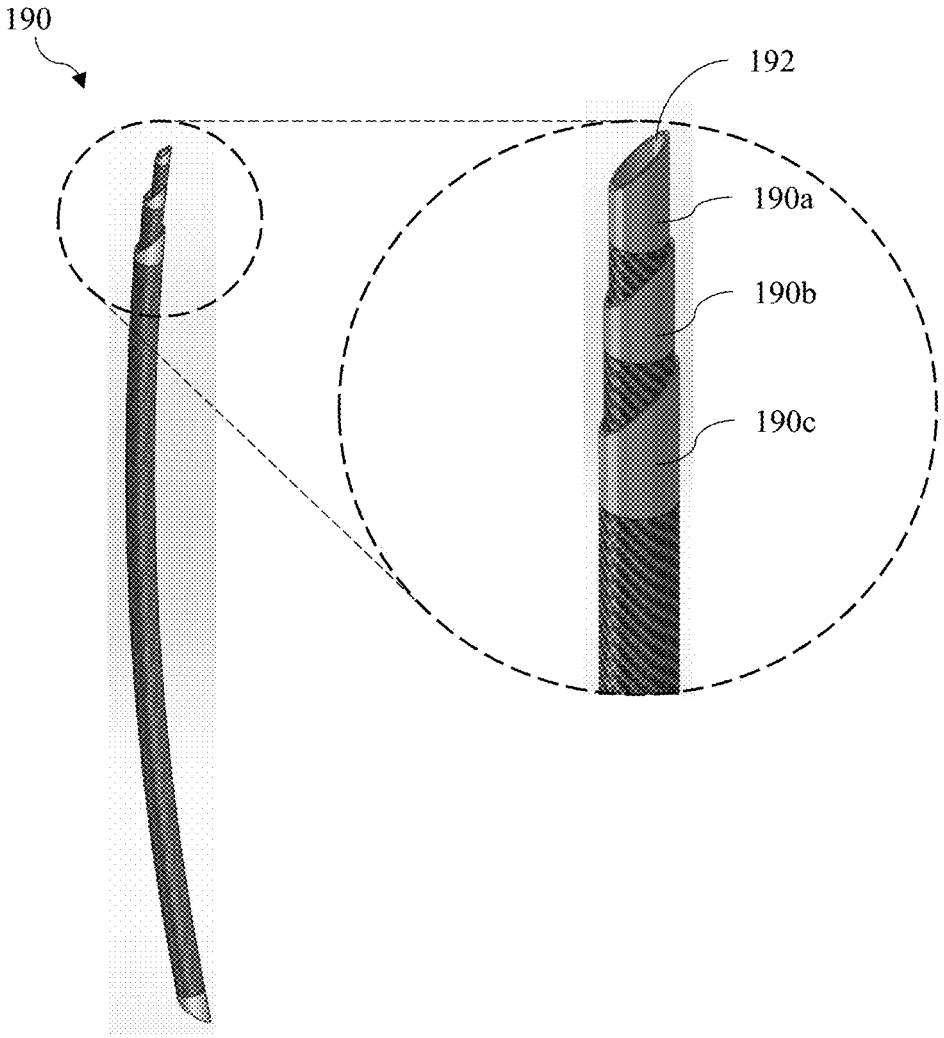
FIG. 14 illustrates a perspective view of an example of strut/tubes shown stowed inside one of another for maximum packing efficiency.

Such a design for satellite antennas allows the struts to be stowed inside one another. FIG. 14 illustrates a perspective view of an example of strut/tubes shown stowed inside one of another for maximum packing efficiency. Longitudinal, batten, and diagonal struts of the truss structure 100 need not have the same diameter. The diameter can step down accordingly such that the strut portions 190*a*, 190*b*, and 190*c* can be stowed for launch with minimal volume allocation, as shown in FIG. 14.

Traditional truss structures have plugged ends that provide threading for attachment and/or a solid plugged end for making mechanical connections or welds. Such a plugged end piece of one of these strut/tubes provides a heat sink for welding to a solid node and avoids the risk of "blowing through" the thin tube wall during welding. For example, a welding machine may apply too much energy and the energy source such as an electric arc, laser beam, or electron beam may melt through the weld interface into an open space and destroys weld continuity as well as the part.

In contrast, the struts 190 described herein can have open ends. The struts can define thin walls and still be welded to the node without risk of blowing through the wall. The node's internal anvil feature stiffens the inside diameter of the tube and avoids any gaps at the weld interface where the weld could blow through.

Figure 15A:
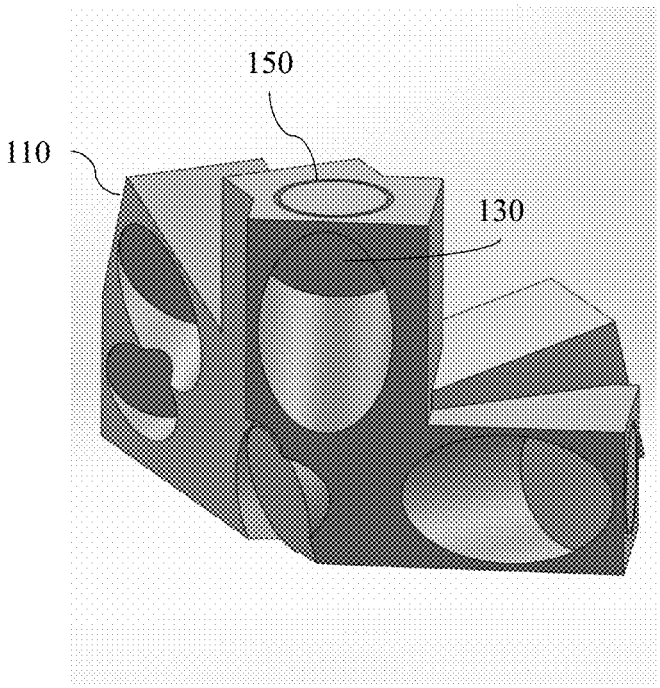
FIG. 15A illustrates a perspective view of an example of a ring truss node with diagonal fitting for a tensegrity strut end demonstrating that all strut ends can still be fit up and welded (2-dimensional) from the exterior position.
Figure 15B:
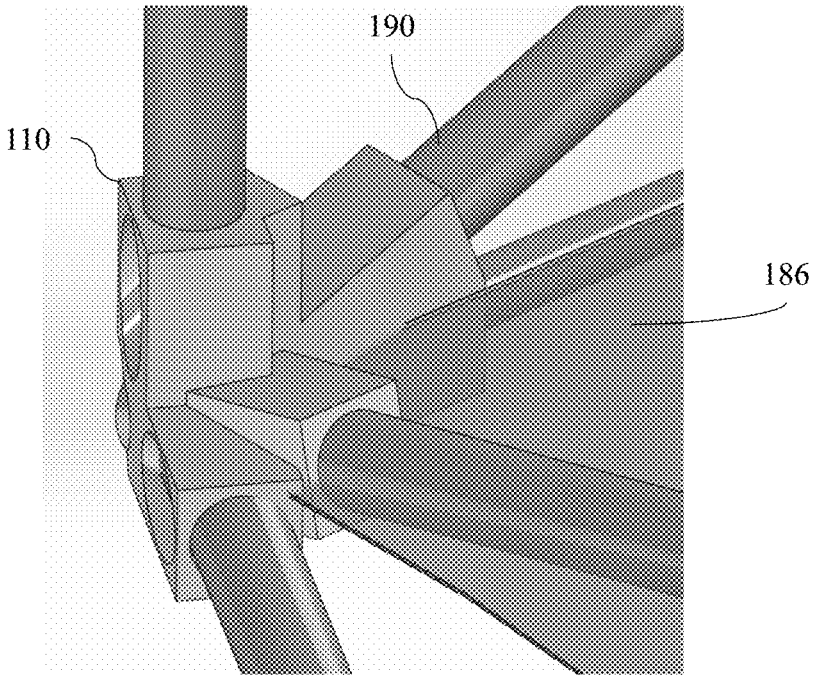
FIG. 15B illustrates another perspective view of the ring truss node of FIG. 15A.

The struts of a tensegrity structure with a reflector element can be designed such that they do not have interference with tension cables and can be inserted into the annual groove of one of the existing nodes used for the ring truss structure. FIG. 15A illustrates a perspective view of an example of a ring truss node with diagonal fitting for a tensegrity strut end demonstrating that all strut ends can still be fit up and welded (2-dimensional) from the exterior position. FIG. 15B illustrates another perspective view of the ring truss node of FIG. 15A. As shown in FIGS. 15A and 15B, the node member 110 and the struts 190 can be assembled and welded in a manner that maintains high stiffness while the tensegrity structure still has freeplay/flexibility at its extents. The ends of the struts 190 can be inserted into the grooves 150 of the node members 110 at the diagonal location. All the tensegrity tube ends can be mechanically locked into the node using the techniques discussed herein. After all the node members 110 are assembled, the joints can be welded at the weld surfaces 130 to lock in the structural positioning and increase stiffness.

Figure 16A:
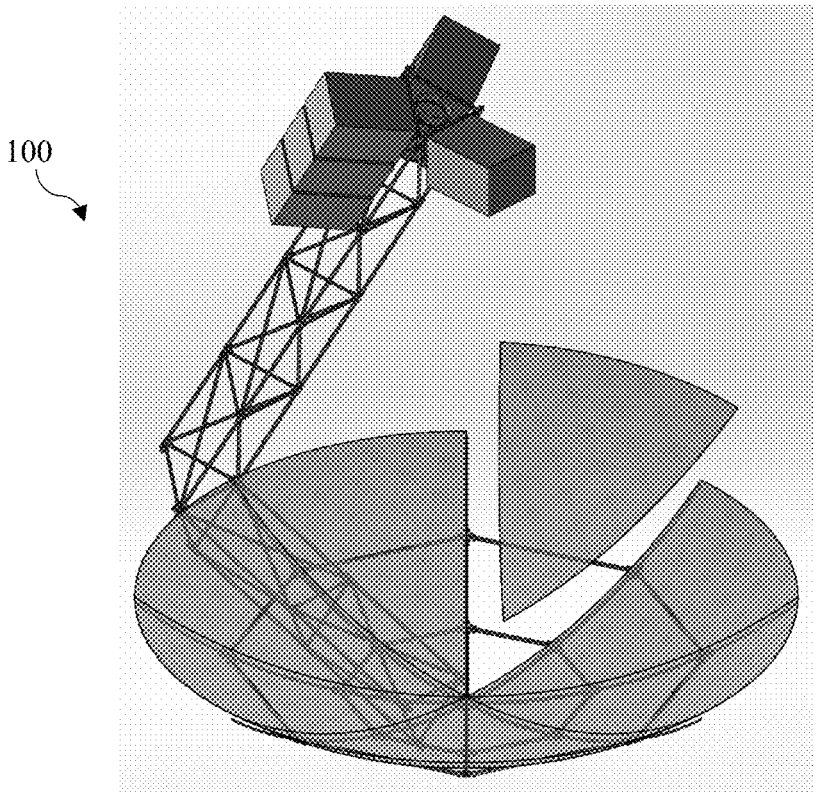
FIG. 16A illustrates a perspective view of an example of a parabolic antenna truss structure design showing various strut and node connections designed for 2-dimensional welding from the exterior position.
Figure 16B:
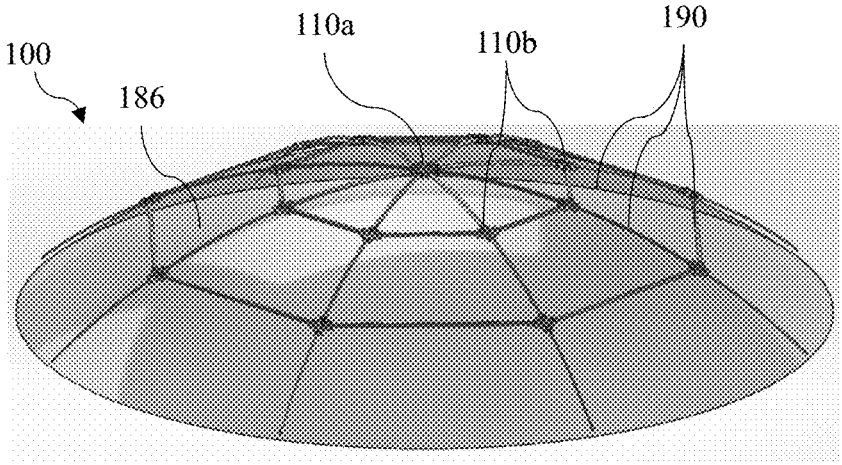
FIG. 16B illustrates another perspective view of the parabolic antenna truss structure design of FIG. 16A.

A parabolic antenna truss structure designs can also be provided with the node design described herein. FIG. 16A illustrates a perspective view of an example of a parabolic antenna truss structure design showing various strut and node connections designed for 2-dimensional welding from the exterior position. FIG. 16B illustrates another perspective view of the parabolic antenna truss structure design of FIG. 16A.

As shown in FIGS. 16A and 16B, node members 110*a* and 110*b* and struts 190 can be assembled to form a parabolic antenna truss structure 100. Using a node-and-strut design to make the stiffened structure, the node and strut connections are mechanically assembled (e.g., using the robotic arms attached to a powered satellite). The struts 190 start connecting at a central hub node member 110*a* in the center of the parabolic dish and the additional rings or webs are connected all the way out to the desired perimeter of the dish with cross-member node members 110*b*. The reflector element 186 can be a metallic mesh that has integrated stiffeners and/or attach points that will connect to holes/attach points on the nodes members 110*a* and 110*b*. The parabolic dish shown can also be a mirror or segments of mirrors that attach at the nodes members 110*a* and 110*b* (FIG. 16A).

Figure 17:
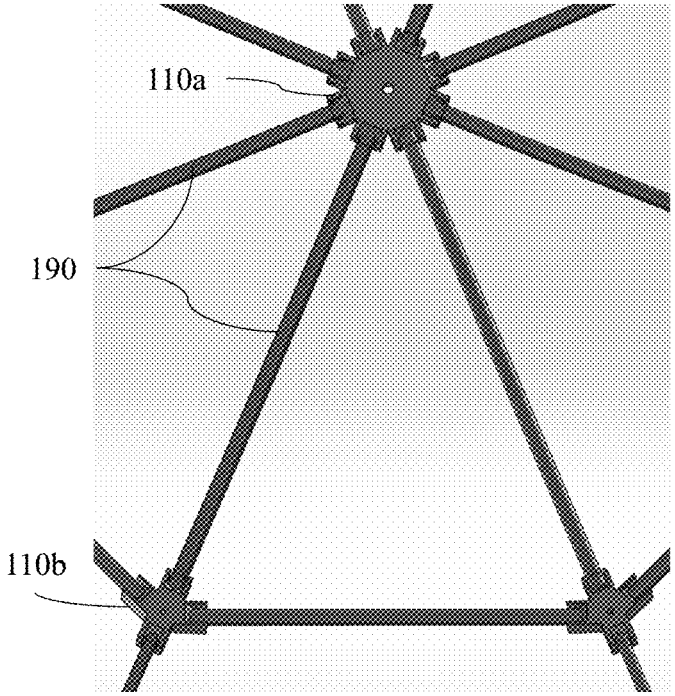
FIG. 17 illustrates a perspective view of an example of parabolic antenna truss nodes with hole features for both positioning the node for precision fit up and joining with struts.

FIG. 17 illustrates a perspective view of an example of parabolic antenna truss nodes with hole features for both positioning the node for precision fit up and joining with struts. The nodes members 110*a* and 110*b* enable connecting of a larger diameter struts 190 closer to the central hub 110*a* to smaller diameters struts 190 moving towards the perimeter of the dish. The intermediate nodes 110*b* in the first ring can transition the largest radial strut to the next size smaller radial strut and so on until the full parabolic aperture diameter has been reached. This enables packs of struts to be stowed inside of one another for ideal packing efficiency, especially for spacecraft. Furthermore, the parabolic reflective element can be additively manufactured from node to node using a robot that travels along the "spider web" truss structure and spirals outwards to fabricate the entire dish.

Figure 18:
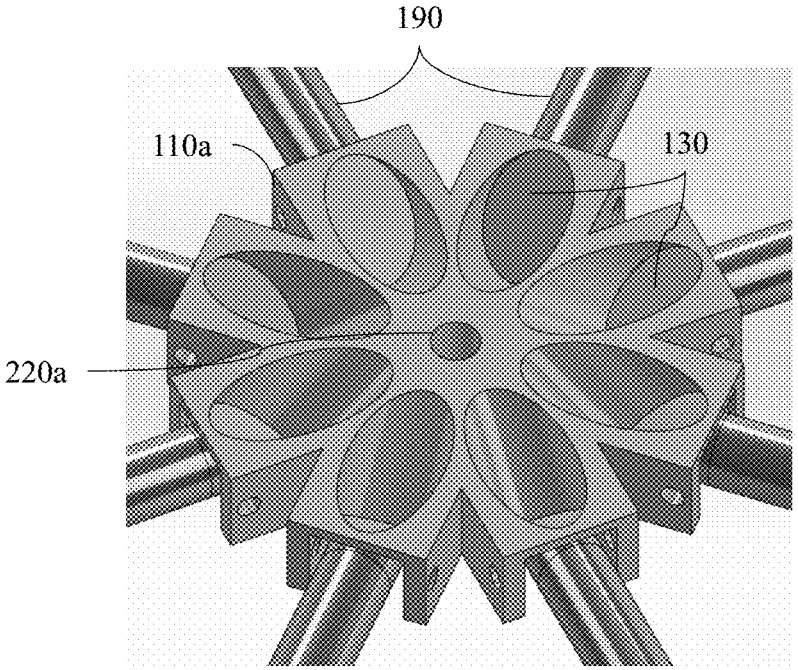
FIG. 18 illustrates a perspective view of an example of parabolic antenna truss nodes showing a central hub node member.

FIG. 18 illustrates a perspective view of an example of parabolic antenna truss nodes showing a central hub node member. The hub node member 110*a* accepts the largest diameter strut/tube and will likely be the same dimension for each radial spoke. As shown in FIG. 17, struts can be inserted into annular grooves of the hub node member 110*a*. The weld surfaces 130 are provided facing inwardly and in directions that converge at a work point. The hub node member 110*a* can include an attachment mechanism 220*a* for connecting the reflector element 186 (e.g., mesh) to the hub node member 110*a*. The attachment mechanism 220*a* can include a hole for receiving a fastener or a fastener for engaging the reflector element 186 directly or indirectly.

Figure 19:
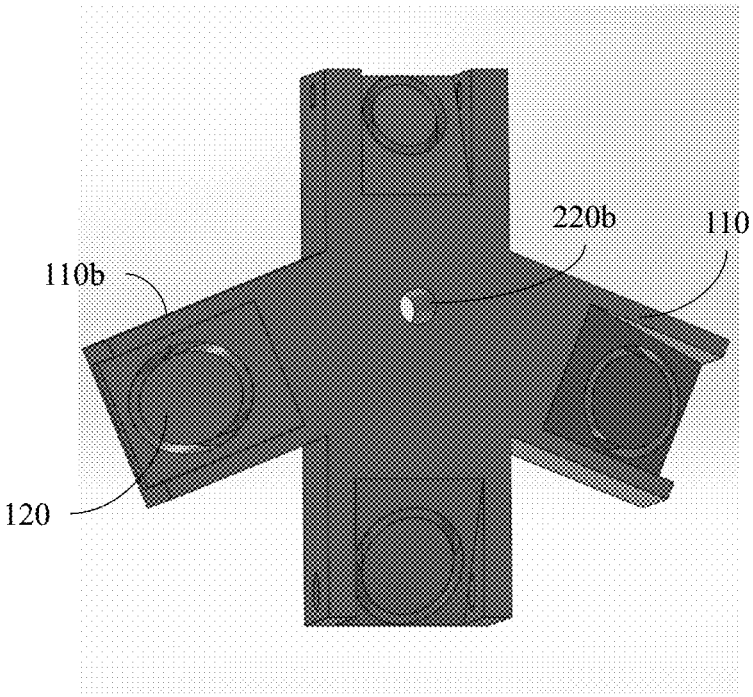
FIGS. 19 and 20 illustrate perspective views of an example of an intermediate node enabling a larger strut diameter to connect to a smaller strut diameter going towards the dish perimeter.
Figure 20:
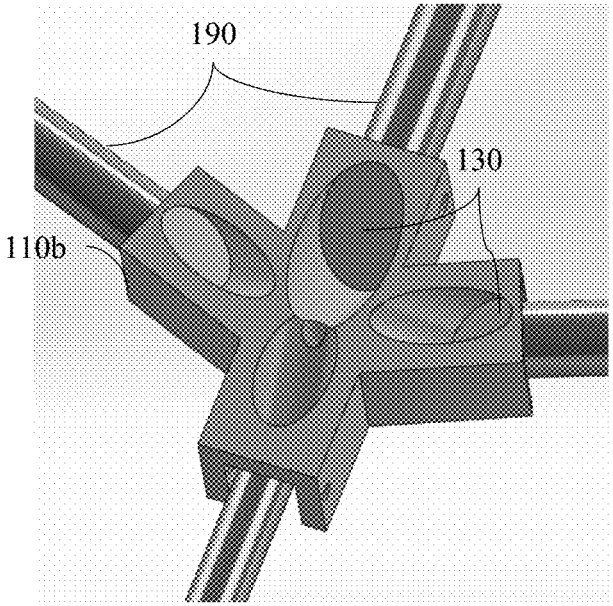

FIGS. 19 and 20 illustrate perspective views of an example of an intermediate node enabling a larger strut diameter to connect to a smaller strut diameter going towards the dish perimeter. The intermediate node member 110*b* accepts the largest diameter strut/tube and will likely be the same dimension for each radial spoke. As shown in FIG. 20, struts 190 can be inserted into annular grooves of the node member 110*a*. The weld surfaces 130 are provided facing inwardly and in directions that converge at a work point. The intermediate node member 110*b* can include an attachment mechanism 220*b* for connecting the reflector element 186 (e.g., mesh) to the intermediate node member 110*b*. The attachment mechanism 220*b* can include a hole for receiving a fastener or a fastener for engaging the reflector element 186 directly or indirectly.

Figure 21:
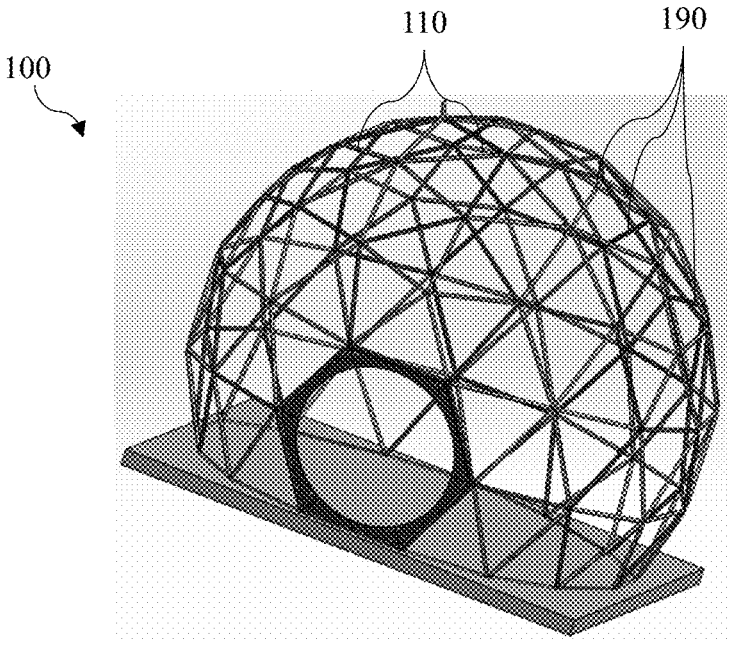
FIG. 21 illustrates a perspective view of an example of a geodesic space frame truss structure with node and strut design.
Figure 22:
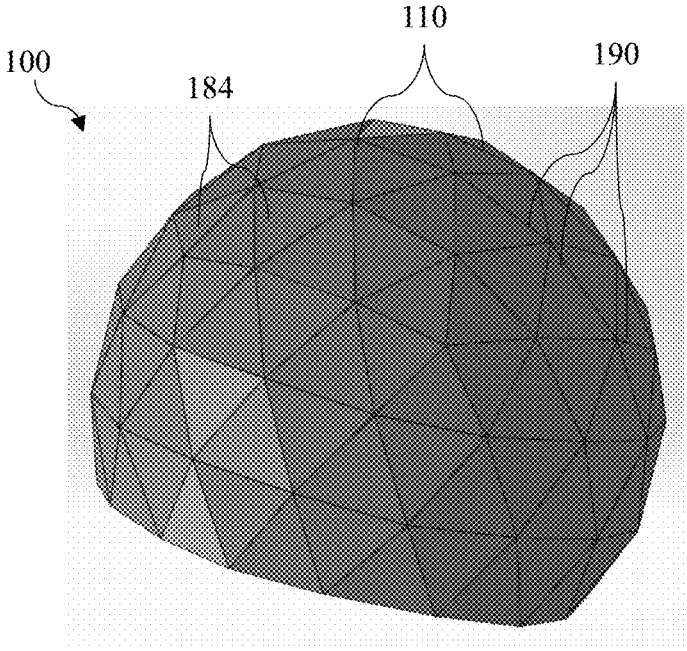
FIG. 22 illustrates a perspective view of an example of a geodesic space frame truss structure with cover panels seal-welded and joined to the nodes to create a hermetically sealed habitat or vessel.

Even further concepts for truss structures can lead to sealed vessels that can be used as air-tight habitats or containment of pressured fuels/gases for fuel depots. FIG. 21 illustrates a perspective view of an example of a geodesic space frame truss structure with node and strut design. FIG. 22 illustrates a perspective view of an example of a geodesic space frame truss structure with cover panels seal-welded and joined to the nodes to create a hermetically sealed habitat or vessel. As shown in FIG. 21, the backbone for this type of structure can use node members 110 and struts 190. As shown in FIG. 22, panels 184 can be attached to the supporting truss structure 100 such that all panels complete a hermetic seal. The approach can utilize familiar geodesic dome or sphere structures.

Figure 23:
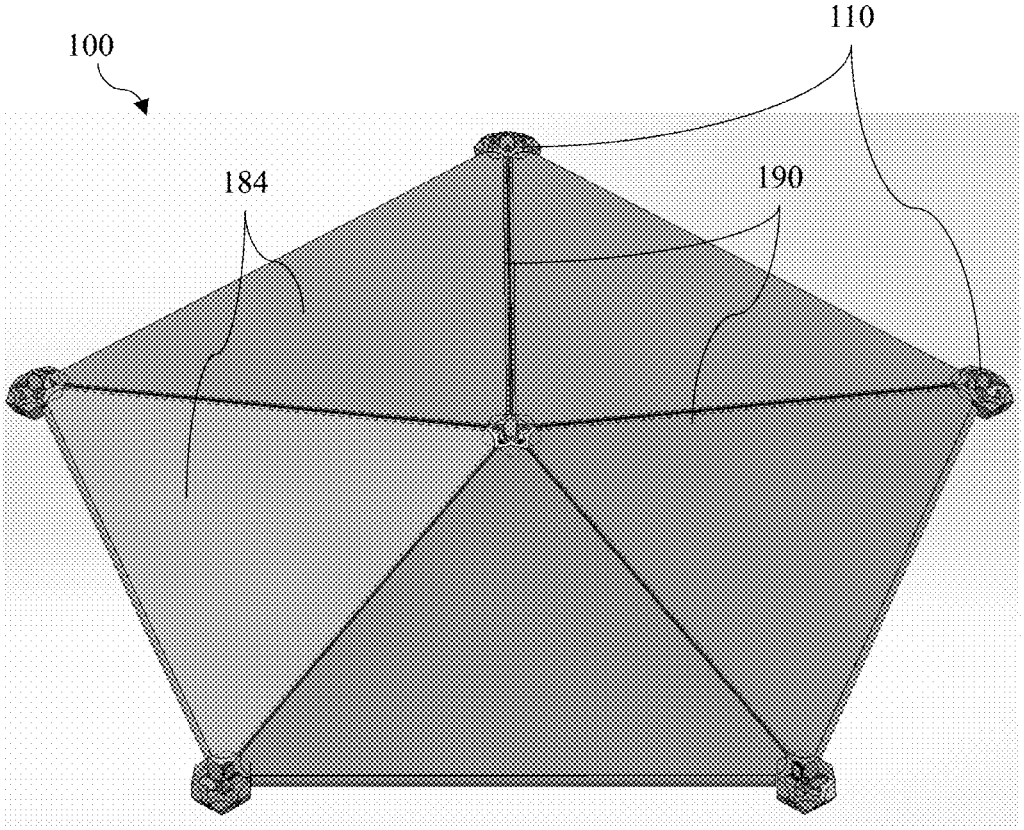
FIG. 23 illustrates a perspective view of an example of a recurring pentagonal node with panels fit up on top of a connecting bar that is supported by strut underneath, allowing the panel to be welded to the bars and nodes in the same 2-D path.

FIG. 23 illustrates a perspective view of an example of a recurring pentagonal node with panels fit up on top of a connecting bar that is supported by strut underneath, allowing the panel to be welded to the bars and nodes in the same 2-D path. As shown in FIG. 23, the geodesic vessel is comprised of hexagonal and pentagonal nodes where panels 184 are fit up with struts 190, a machined connector bar, and node members 110 such that each individual panel 184 can be butt-lap welded in 2-dimensions along its perimeter.

Figure 24A:
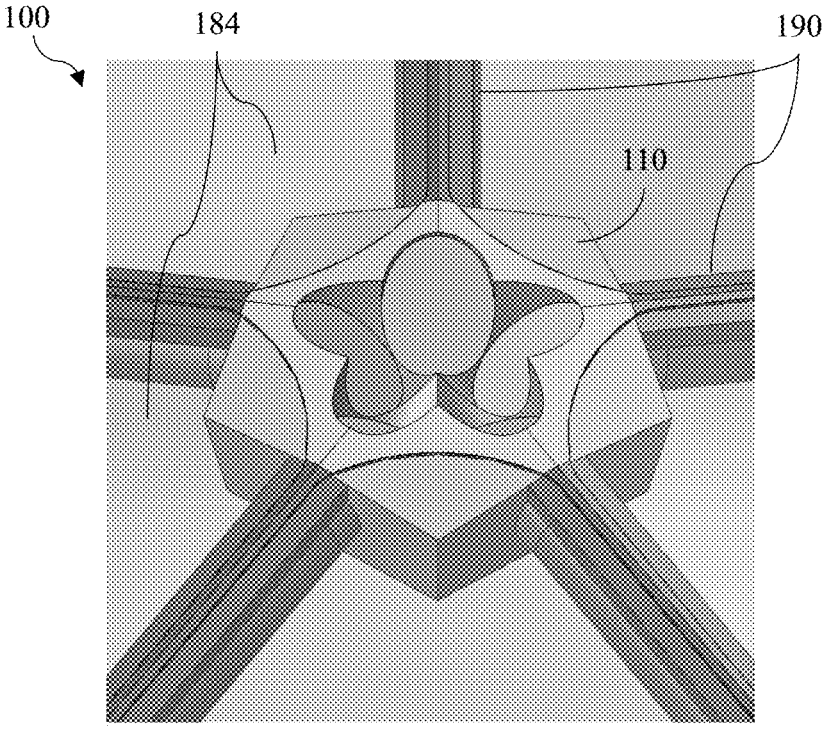
FIG. 24A illustrates a perspective view of an example of a central pentagonal node with recessed edges that allow for the panel to be butt-lap welded.
Figure 24B:
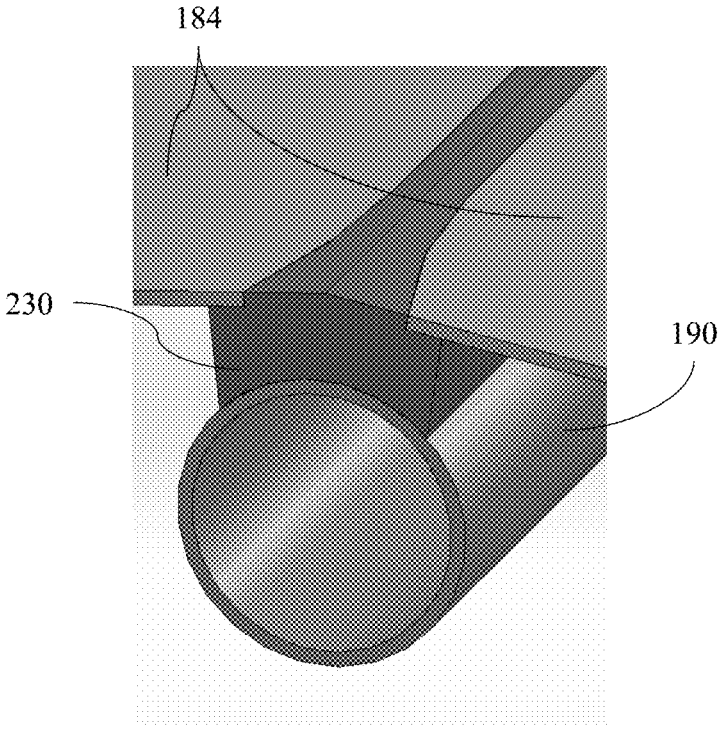
FIG. 24B illustrates a sectional perspective view of the node of FIG. 24A with the connector bar installed on top of the strut as well as the panel fit up with the recess of the connector bar.

FIG. 24A illustrates a perspective view of an example of a central pentagonal node with recessed edges that allow for the panel to be butt-lap welded. FIG. 24B illustrates a sectional perspective view of the node of FIG. 24A with the connector bar installed on top of the strut as well as the panel fit up with the recess of the connector bar. As shown in FIG. 24B, connector bars 230 are supported upon struts 190 and connect the struts 190 to the reflector element 186. The connector bar 230 can be secured to the strut 190 and/or the node member 110 with a mechanical fastener, spring-loaded press-fit mechanism, etc. The panels 184 (e.g., triangular panels) can also have a small projecting feature at each of the tips that can be mechanically assembled with the node member 110 with a mechanical fastener, spring-loaded press-fit mechanism, etc. A robotic welding head will have sufficient 2-dimensional travel such that it can weld the perimeter of a single panel 184. The robotic arms will continuously reposition the structure to add the required pieces and move the next panel 184 into position to be welded. For example, the connector bars 230, the panels 184, and the node members 110 can be welded together. Each portion of the corresponding weld can be in a two-dimensional plane, thereby avoiding complications of welding in three dimensions. Thus, the welding robot only requires a minimal operation window because it is welding a small quadrant at a time to make a very large structure.

Figure 25A:
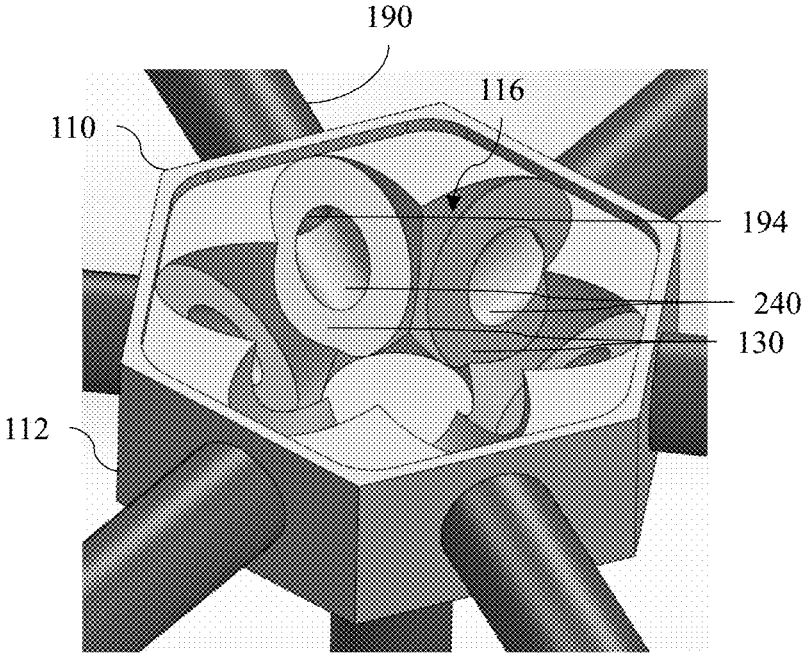
FIG. 25A illustrates a perspective view of an example of a hexagonal node with machined recess for 2-D butt-lap weld and through holes for conveying fluid.

In one or more of the designed illustrated herein, fluid cooling can be provided by a network of interconnected struts and node members. FIG. 25A illustrates a perspective view of an example of a hexagonal node with machined recess for 2-D butt-lap weld and through holes for conveying fluid. As shown in FIG. 25A, the main body 112 of the node member can define openings 240 extending through the weld surfaces 130. The struts 190 can also define lumens 194. The lumens 194 of different struts can be in fluid communication with each other through the openings 240 of the main body 112.

The network of sealed node members 110 and hollow struts 190 allow the structure to be actively or passively cooled using a variety of cooling fluids and techniques. The cooling feature is especially helpful for space structures since one such structure could provide a dual-purpose for enhanced in-space utility. Hence, the same truss structure used for an antenna or telescope could also be used to cool the structure down to prevent thermal distortion from the heat of the sun. Likewise, truss structures used to construct in-space habitats, fuel depots, or life-support systems could utilize the network of nodes and tubes for cooling and/or heating purposes.

The weld surfaces 130 (e.g., elliptical faces) of the node members can be provided with such lumens while still providing an area sufficient to perform a 2-D weld path and effectively join the struts 190 to the node member 110.

Figure 25B:
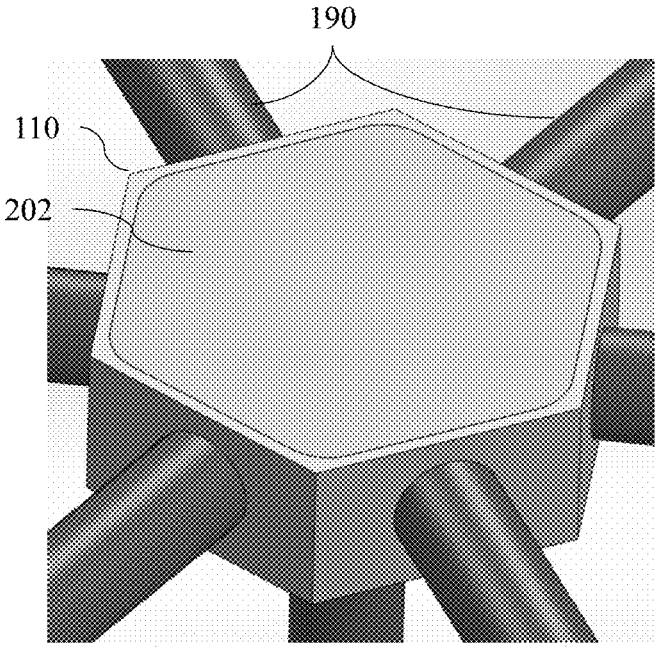
FIG. 25B illustrates a perspective view of an example of a cap member installed flush with a node such that it can be welded around the perimeter.

In one or more of the designed illustrated herein, a cap member can be provided to an exterior face of a mode member. FIG. 25B illustrates a perspective view of an example of cap member installed flush with a node such that it can be welded around the perimeter. As shown in FIG. 25B, a cap member 202 is provided over a portion of the node member 110. In particular, the cap member 202 can enclose the interior region 116 shown in FIG. 25A. As such, the fluid communication provided through the interior region 116 can be sealed so that fluid traveling therein is retained. The interior region 116 is thereby sealed from an external environment.

The cap member 202 can also provide more stiffness to the node member 110. As the main body 112 defined the interior region 116 having an open space, less structural support is provided in this region. The cap member 202 stiffens the top end of the node member, which has more material removed than the bottom face. This increases stiffness while also creating a hermetically sealed network of nodes and tubes that is adequate for passing fluids through.

Figure 26:
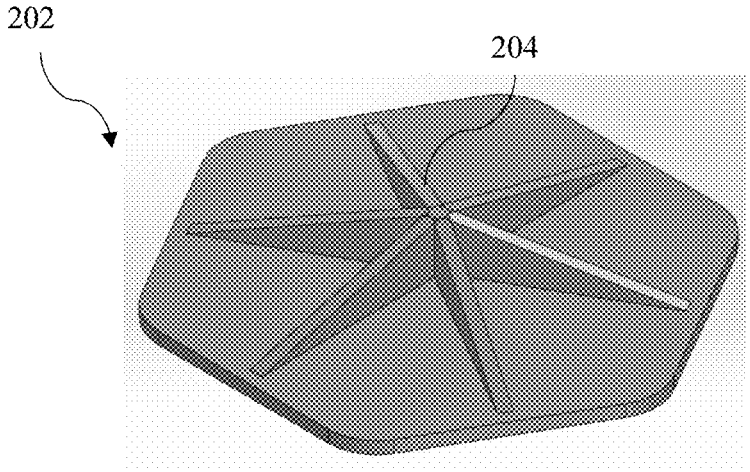
FIG. 26 illustrates a perspective view of an example of a cap member with gusset features to increase stiffness at top of node.

FIG. 26 illustrates a perspective view of an example of a cap member with gusset 204 features to increase stiffness at top of node. The gusset 204 can fit within the interior region of the main body of the node member.

Figure 27:
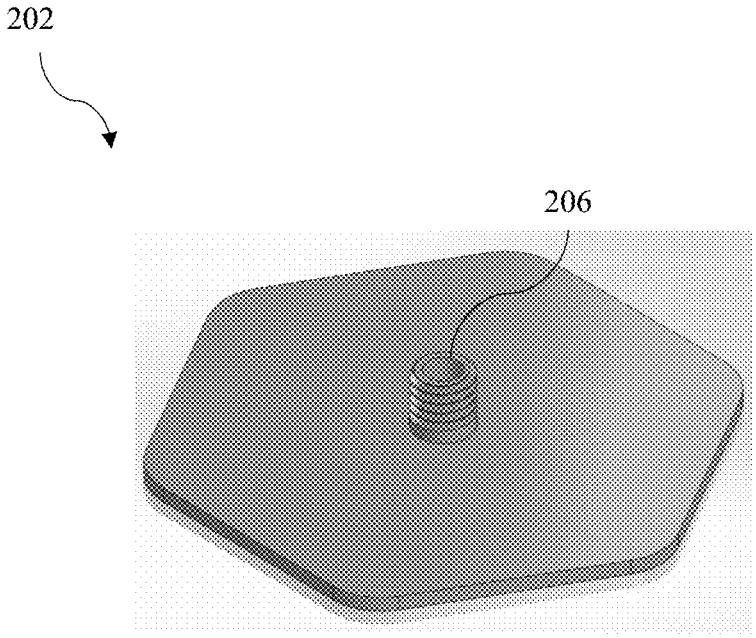
FIG. 27 illustrates a perspective view of an example of a cap member with a fitting for flowing fluid or pressurizing the network of sealed nodes and struts.

FIG. 27 illustrates a perspective view of an example of a cap member with a fitting 206. The fitting can engage and/or be engaged by the main body 112 of the node member 110. Secure engagement and sealing can be accomplished by the interaction of the fitting 206 and the node member 110.

Figure 28:
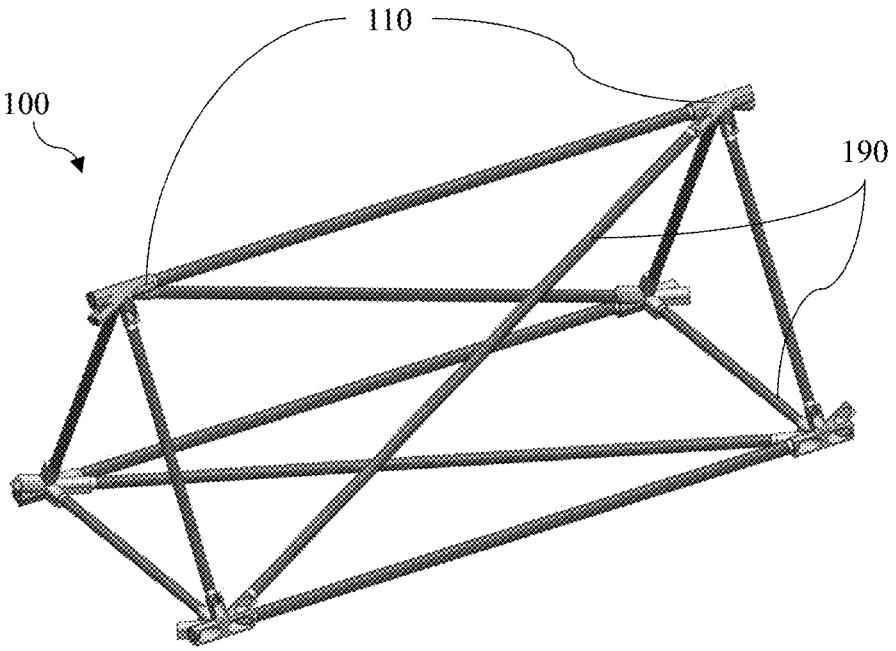
FIG. 28 illustrates a perspective view of an example of a prismatic truss structure segment showing 3 different strut lengths and diameters, but all utilizing the same node in 6 locations.
Figure 29:
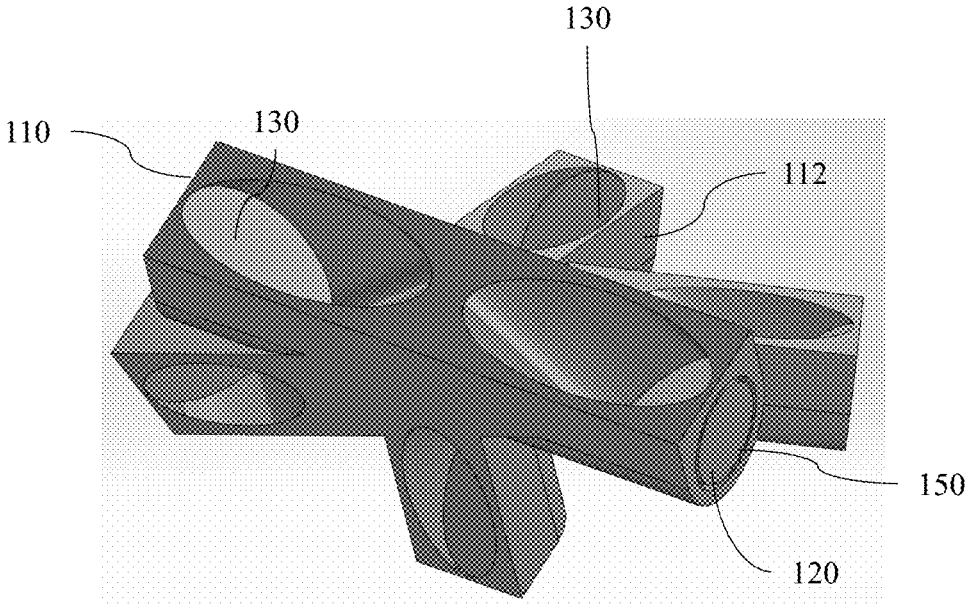
FIG. 29 illustrates a perspective view of an example of a prismatic truss structure node with branches to accept strut ends at each location with a precise annular groove and 2-D welding face that is accessible from the exterior position.

Referring now to FIGS. 28 and 29, a prismatic truss structure can be formed by the assembly of node members and struts. FIG. 28 illustrates a perspective view of an example of a prismatic truss structure segment showing three different strut lengths and diameters, but all utilizing the same node in six locations. As shown in FIG. 28, the prismatic truss structure 100 is formed with a single prism segment that can be repeated and reconfigured in a variety of different structural shapes. This structure can utilize struts 190 of different diameter and lengths, but still connect to the same node member 110 on each corner of the prism. This is ideal for spacecraft payload scenario because the tubes can still be stowed within each other in small packing volume while the nodes can also pack efficiently where only a single node design is needed to make the repeated truss segments.

The prismatic truss structure 100 of FIG. 28 can be assembled with the node configuration illustrated in FIG. 29. FIG. 29 illustrates a perspective view of an example of a prismatic truss structure node with branches to accept strut ends at each location with a precise annular groove and 2-D welding face that is accessible from the exterior position. As shown in FIG. 29, a node member 110 for a truss structure can include a main body 112. Struts can be inserted into annular grooves 150 of the node member 110. Each annular groove 150 can extend from a periphery of the main body 112 inwardly toward an interior region of the main body 112. At least some of the weld surfaces 130 are provided facing inwardly and in directions that converge at a work point. Other weld surfaces 130 can be provided facing in directions that converge at a second work point. Nonetheless, the work points can still facilitate alignment for a weld tool operating on corresponding weld surfaces 130.

Figure 30A:
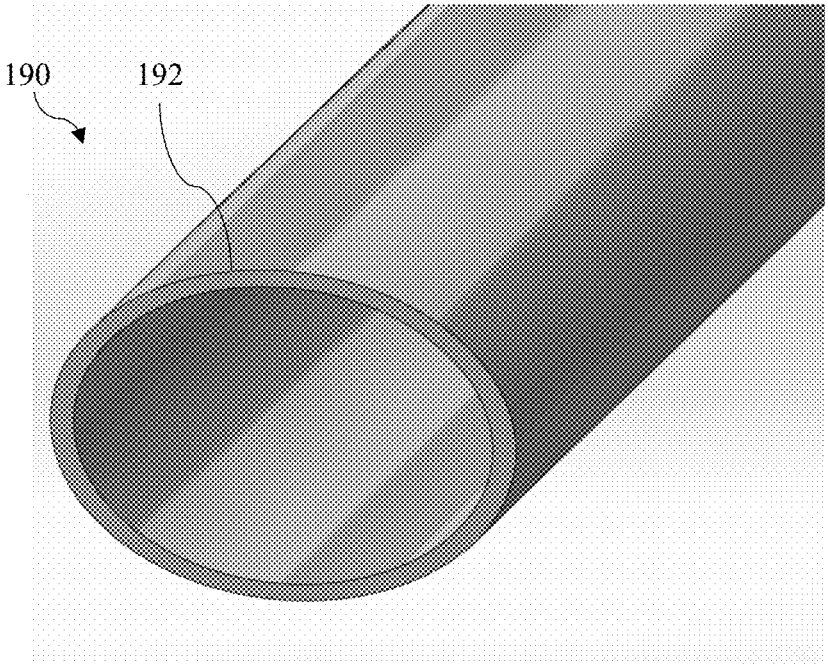
FIG. 30A illustrates a perspective view of an example of an elliptical strut end when cut at a 45-degree angle, which provides a circular face when facing normal to the newly cut face.
Figure 30B:
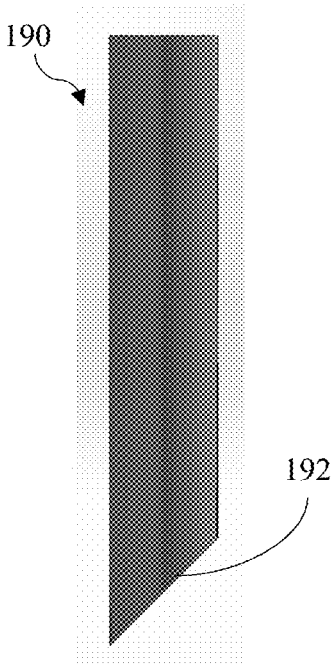
FIG. 30B illustrates a side view of an example of the strut of FIG. 30A.
Figure 30C:
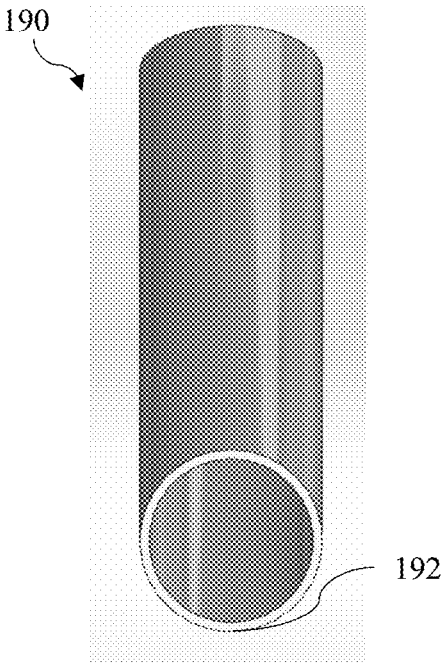
FIG. 30C illustrates another side view of an example of the strut of FIG. 30A.

Referring now to FIGS. 30A-30C, one or more of the embodiments described herein can employ struts 190 that extend along a longitudinal axis and have a terminal end 192. Along the length, the struts 190 can be cylindrical with a circular cross-section. At the terminal ends 192, the struts 190 can provide a surface at an angle such that the end face is elliptical. The angle can be with respect to the longitudinal axis of the strut 190. The angle can be between 30 and 60 degrees, for example 45 degrees. The elliptical face is inserted into the annular groove of the node member and mates up with an elliptical face at the interior end thereof. Opposite this end is the weld surface. In some embodiments, it might beneficial to use an elliptical tube where the angled cut end face becomes circular. The tube ends can be inserted into an elliptical internal anvil of the node and mate up with a circular face. Thus, the face of node at the interface of the tube will be circular and the weld path can also be circular. This allows more area on the node for fitting in circular cutouts instead of elliptical and an array of elliptical tubes has better packing efficiency than circular tubes. This could make the weld path and programming easier and enables other welding processes to be used such as resistance stud welding, friction stud welding, friction push plug welding, or deformation resistance welding.

The struts described herein can be a single material or multi-material as long as the material on the end of the tubes can be joined via welding. The multi-material struts/tubes have the advantage of having neutral Coefficient of Thermal Expansion (CTE) that is highly desirable for precision space structures because of the large variation in temperature in space.

Figure 31A:
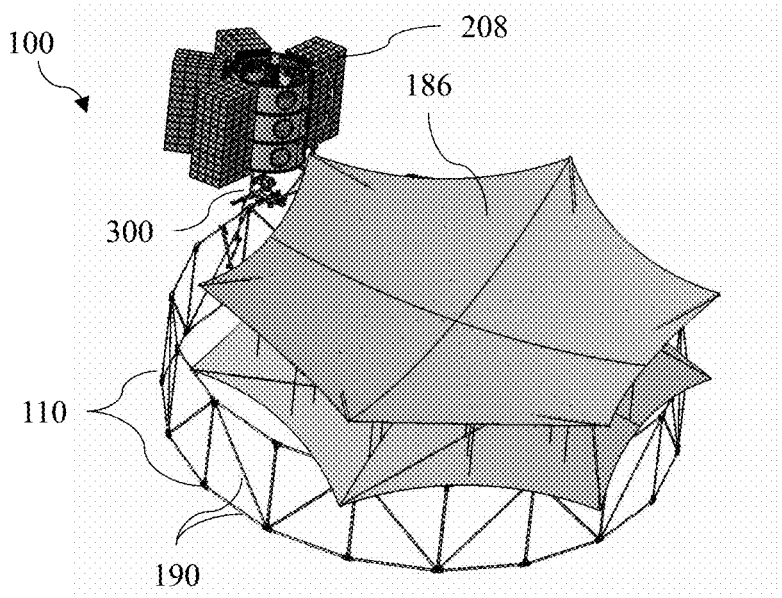
FIG. 31A illustrates a perspective view of a robotic arm installing an unfurled tensegrity structure into the cylindrical rim truss structure to complete an antenna reflector.
Figure 31B:
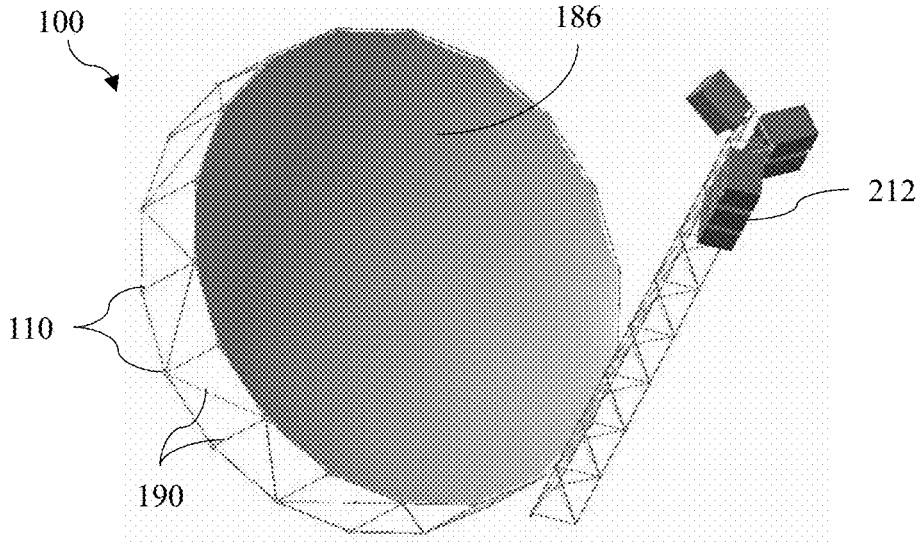
FIG. 31B illustrates a perspective view of an in-space manufactured prismatic truss with subreflector and satlets positioned above the reflector.

Referring now to FIGS. 31A and 31B, the structures described herein can be assembled by an automated process. The features of the disclosed structures and methods can benefit from an in-space assembled and welded cylindrical rim truss and a tensegrity deployable element to manufacture a functional antenna in space where all the materials required can fit into a minimal payload volume.

The components required for assembly can be stored and transported within a mobile unit 208 having thrust capabilities and assembly mechanisms. As shown in FIG. 31A, the mobile unit 208 can assemble a truss structure 100 that serves as structural support for an antenna. The truss structure 100 can include node members 110 and struts 190 that are deployed and welded together as described herein by a welding tool 300 of the mobile unit 208. A reflector element 186 can be provided and supported by the truss structure 100.

As shown in FIG. 31B, other structures can be assembled, such as a prismatic truss structure. These additional structures can be assembled by the same methods and by the same mobile unit. Thus, the versatility of this design allows another form of the structure (e.g., prismatic truss structure) to be utilized on the base structure (e.g., antenna support) to complete the functional antenna by integrating a prismatic truss structure to position the subreflector element 186. The additional components 212 shown on the prismatic truss structure are microsatellites or cubesats that fly as ride shares on the secondary payload adapter.

Accordingly, the designs disclosed herein provide an ability to build structures in space more efficiently to enable capability growth and capability preservation of various space-based functions such as human exploration, scientific discovery, and satellite operations. The structures can be stored in a compact payload and assembled in space. Alignment mechanisms to facilitate automated assembly are provided to produce strong and durable truss structures that can be assembled in space.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

What is claimed is:

1. A truss structure comprising:

a node member comprising:

a main body;

annular grooves each extending from an outer periphery of the main body toward an interior region of the main body, wherein the interior region defines a void within the main body; and weld surfaces each facing the interior region, covering an interior end of a corresponding one of the annular grooves, and being opposite the outer periphery, wherein all of the weld surfaces face in directions that converge at a work point;

struts, wherein each of the struts is inserted into a corresponding one of the annular grooves; and weld nuggets each on a corresponding one of the weld surfaces and extending to a corresponding one of the struts.

2. The truss structure of claim 1, wherein each weld surface is planar, and a weld axis perpendicular to the weld surface intersects the work point.

3. The truss structure of claim 1, further comprising anvils each extending from the main body and within a corresponding one of the annular grooves.

4. The truss structure of claim 3, wherein the main body is monolithic with the anvils.

5. The truss structure of claim 3, wherein the anvils are attached to the main body with fasteners.

6. The truss structure of claim 1, further comprising coupling members each extending within a corresponding one of the annular grooves and configured to securely couple the node member to one of the struts that is inserted into the corresponding one of the annular grooves.

7. The truss structure of claim 1, wherein a thickness of the main body between one of the weld surfaces and the corresponding one of the annular grooves is substantially consistent about the periphery of the corresponding one of the annular grooves.

8. A truss structure comprising:

a node member comprising:

a main body;

annular grooves each extending from a periphery of the main body toward an interior region of the main body; and weld surfaces each covering an interior end of a corresponding one of the annular grooves, wherein all of the weld surfaces face in directions that converge at a work point;

struts, wherein each of the struts is inserted into a corresponding one of the annular grooves with a terminal end at the interior end of the corresponding one of the annular grooves; and weld nuggets each on a corresponding one of the weld surfaces and extending to a corresponding one of the struts.

9. The truss structure of claim 8, wherein each of the weld nuggets forms a ring on a corresponding one of the weld surfaces.

10. The truss structure of claim 8, wherein the main body defines openings extending through the weld surfaces and the struts define lumens that are in fluid communication with each other through the openings of the main body.

11. The truss structure of claim 10, further comprising a cap member sealing the interior region of the main body from an external environment, the interior region being in fluid communication with the lumens through the openings.

12. The truss structure of claim 8, wherein each strut extends along a longitudinal axis and the terminal end of each strut defines a face that is directed at an angle with respect to the longitudinal axis.

13. The truss structure of claim 12, wherein the angle is oblique for at least some of the struts.

14. The truss structure of claim 12, wherein the angle is zero for at least one of the struts.

15. The truss structure of claim 8, wherein the face is parallel to the interior end of the corresponding one of the annular grooves and the corresponding one of the weld surfaces.

16. The truss structure of claim 8, further comprising a reflector element coupled to the node member.

17. A method comprising:

inserting struts into corresponding annular grooves of a node member with terminal ends of each of the struts at an interior end of the corresponding one of the annular groove, the node member comprising weld surfaces each covering the interior end of a corresponding one of the annular grooves, wherein all of the weld surfaces face in directions that converge at a work point;

aligning a weld device at a work point; and while the weld device is aligned at the work point, welding at each of the weld surfaces to weld each of the struts to the node member.

18. The method of claim 17, wherein inserting the struts comprises advancing each strut within a corresponding one of the annular grooves until a coupling member extending within the corresponding one of the annular grooves securely couples the strut to the node member.

19. The method of claim 17, further comprising securing the node member to an assembly platform with a node alignment mechanism of the node member.

20. The method of claim 17, further comprising:

inserting anvils each into a corresponding one of the annular grooves; and securing each of the anvils to the node member with fasteners, wherein inserting the struts comprises advancing the struts over the anvils.

* * * * *